US012774547B2

(12) United States Patent
Hahm et al.

(10) Patent No.: US 12,774,547 B2
(45) Date of Patent: Oct. 27, 2026

(54) WASHING MACHINE AND CONTROL METHOD THEREOF

(71) Applicant: Samsung Electronics Co., Ltd., Suwon-si (KR)

(72) Inventors: Seongil Hahm, Suwon-si (KR); Kanghyun Kim, Suwon-si (KR); Jihyun Woo, Suwon-si (KR); Sangwon Ahn, Suwon-si (KR); Junhyun Park, Suwon-si (KR); Eunsuk Bang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 224 days.

(21) Appl. No.: 18/508,698

(22) Filed: Nov. 14, 2023

(65) Prior Publication Data

US 2024/0084490 A1 Mar. 14, 2024

Related U.S. Application Data

(63) Continuation of application No. PCT/KR2022/007462, filed on May 26, 2022.

(30) Foreign Application Priority Data

Jun. 25, 2021 (KR) ..... 10-2021-0083432

(51) Int. Cl.
*D06F 34/18* (2020.01)
*D06F 33/32* (2020.01)
(Continued)

(52) U.S. Cl.
CPC ..... *D06F 34/18* (2020.02); *D06F 33/32* (2020.02); *D06F 34/10* (2020.02); *D06F 39/087* (2013.01);
(Continued)

(58) Field of Classification Search
CPC ..... D06F 33/32; D06F 34/10; D06F 34/18; D06F 39/087; D06F 2103/14; D06F 2103/18; D06F 2103/04; D06F 2103/06
See application file for complete search history.

(56) References Cited

U.S. PATENT DOCUMENTS 11,427,955 B2 8/2022 Park
11,447,904 B2 9/2022 Im et al.
(Continued)

FOREIGN PATENT DOCUMENTS

JP 2009089852 A 4/2009
JP 2019084340 A 6/2019
(Continued)

OTHER PUBLICATIONS

International Search Report for PCT/KR2022/007462 mailed Sep. 15, 2022, 4 pages.
(Continued)

*Primary Examiner* — Joseph L. Perrin
(74) *Attorney, Agent, or Firm* — Nixon & Vanderhye P.C.

(57) ABSTRACT

A washing machine according to an embodiment comprises: a drum; a motor configured to rotate the drum; a motor driver comprising circuitry configured to a drive current to the motor; a current sensor configured to sense the drive current; a water supplier comprising a conduit configured to supply water to the drum; and at least one controller, wherein one or more of the at least one processor is configured to control the water supplier to perform a plurality of water supply processes, and control the motor driver to perform a plurality of material detection processes, wherein one or more of the at least one controller is configured to: in response to one water supply process from among the plurality of water supply processes, one material detection process from among the plurality of material detection processes, generate a plurality of pieces of input
(Continued)

data based on a value of the drive current detected during the plurality of material detection processes, and determine the material of laundry accommodated in the drum, on the basis of the plurality of pieces of input data.

9 Claims, 25 Drawing Sheets

(51) Int. Cl.

| | |
|---|---|
| ***D06F 34/10*** | (2020.01) |
| ***D06F 39/08*** | (2006.01) |
| *D06F 103/04* | (2020.01) |
| *D06F 103/06* | (2020.01) |
| *D06F 103/14* | (2020.01) |
| *D06F 103/18* | (2020.01) |

(52) U.S. Cl.
CPC ..... *D06F 2103/04* (2020.02); *D06F 2103/06* (2020.02); *D06F 2103/14* (2020.02); *D06F 2103/18* (2020.02)

(56) References Cited

U.S. PATENT DOCUMENTS

| | | | | |
|---|---|---|---|---|
| 11,725,329 | B2 | 8/2023 | Im et al. | |
| 2012/0005840 | A1 | 1/2012 | Jang et al. | |
| 2015/0047128 | A1 | 2/2015 | Goshgarian et al. | |
| 2015/0121631 | A1* | 5/2015 | Kang | D06F 34/18 68/12.04 |
| 2019/0301071 | A1* | 10/2019 | Altinier | G06N 7/00 |
| 2019/0368103 | A1* | 12/2019 | Choung | D06F 33/76 |
| 2020/0040508 | A1* | 2/2020 | Park | D06F 73/02 |
| 2020/0095719 | A1 | 3/2020 | Im et al. | |
| 2020/0102685 | A1* | 4/2020 | Im | D06F 37/304 |
| 2020/0199642 | A1* | 6/2020 | Jeong | C12Q 1/04 |

FOREIGN PATENT DOCUMENTS

| | | | |
|---|---|---|---|
| KR | 100335083 | B1 | 5/2002 |
| KR | 20120012215 | A | 2/2012 |
| KR | 20150052697 | A | 5/2015 |
| KR | 20190106924 | A | 9/2019 |
| KR | 20200025554 | A | 3/2020 |
| KR | 20200026042 | A | 3/2020 |
| KR | 20200026043 | A | 3/2020 |
| WO | 2021045258 | A1 | 3/2021 |

OTHER PUBLICATIONS

Written Opinion of the ISA for PCT/KR2022/007462 mailed Sep. 15, 2022, 4 pages.

* cited by examiner

FIG. 18

| WEIGHT OF DRY LAUNDRY | WATER SUPPLY STAGE |
|---|---|
| 0 ~ 1 kg | FIRST STAGE |
| 1 ~ 2 kg | SECOND STAGE |
| 2 ~ 3 kg | THIRD STAGE |
| 3 ~ 4 kg | FOURTH STAGE |
| 4 ~ 5 kg | FIFTH STAGE |

WASHING MACHINE AND CONTROL METHOD THEREOF

CROSS-REFERENCE TO RELATED APPLICATIONS

This application is a continuation of International Application No. PCT/KR2022/007462 designating the United States, filed on May 26, 2022, in the Korean Intellectual Property Receiving Office and claiming priority to Korean Patent Application No. 10-2021-0083432, filed on Jun. 25, 2021, in the Korean Intellectual Property Office, the disclosures of each of which are incorporated by reference herein in their entireties.

BACKGROUND

Field

The disclosure relates to a washing machine and a control method thereof, and for example, to a washing machine capable of detecting a material of laundry, and a control method thereof.

Description of Related Art

A washing machine is capable of performing a washing process to wash laundry, a rinse process to rinse the washed laundry, and a spin-dry process to remove water from the laundry.

In order to perform such processes, process conditions such as a type of detergent, a washing time, an agitation pattern, the number of rinses, and a spin speed are required to be set appropriately. Because proper process conditions vary depending on a material of laundry, the material of the laundry is required to be identified before performing the wash.

Because the amount of moisture content (the degree of water retention) varies depending on a material of laundry, even when water is supplied at the same water level, the actual amount of water supply varies depending on the material of the laundry. Such a difference is shown in current change characteristics of a motor during rotation of a drum, and thus the material of the laundry may be identified using the current change characteristics of the motor.

SUMMARY

Embodiments of the disclosure provide a washing machine that may perform water supply processes in stages and perform a material detection process each time each of the water supply processes is completed, thereby improving an accuracy of identifying a material of laundry, and a control method thereof.

Embodiments of the disclosure provide a washing machine that may perform a material detection process using a motor current value in a frequency domain, thereby identifying a material of laundry using data obtained while a drum rotates at a constant speed, and a control method thereof.

Embodiments of the disclosure provide a washing machine that may improve an accuracy of identifying a material of laundry using a plurality of classifiers which are trained by machine learning and reflect characteristics of each of a plurality of processes, and a control method thereof.

According to an example embodiment of the disclosure a washing machine is provided, the washing machine including: a drum; a motor configured to rotate the drum; a motor driver comprising circuitry configured to supply a drive current to the motor; a current sensor configured to detect the drive current; a water supplier comprising a conduit configured to supply water to the drum; and at least one controller configured to control the water supplier to perform a plurality of water supply processes, and control the motor driver to perform a plurality of material detection processes, wherein one or more of the at least one controller may be configured to: perform one of the plurality of material detection processes in response to one of the plurality of water supply processes, generate a plurality of pieces of input data based on the drive current values detected during the plurality of material detection processes, and identify a material of laundry, accommodated in the drum, based on the plurality of pieces of input data.

The plurality of pieces of input data may include at least one of data about a frequency component of the drive current values detected during the plurality of material detection processes and data about an alignment pattern in which the drive current values are aligned in order of magnitude.

One or more of the at least one controller may be configured to store a classifier pre-trained by machine learning, wherein the classifier may be configured to output output data indicating the material of the laundry accommodated in the drum, in response to the plurality of pieces of input data being input.

One or more of the at least one controller may be configured to determine a number of the plurality of water supply processes based on a weight of the laundry accommodated in the drum.

One or more of the at least one controller may be configured to cancel a water supply process, in response to a water supply time or an amount of water supply for one of the plurality of water supply processes satisfying a specified condition.

One or more of the at least one controller may be configured to control the motor driver to rotate the drum at a constant speed to perform the plurality of material detection processes.

The classifier may be configured to include two or more classifiers pre-trained by two or more processes among the plurality of material detection processes and the plurality of weight detection processes identifying a weight of the laundry before supplying water to the drum.

One or more of the at least one controller may be configured to identify the material of the laundry, accommodated in the drum, based on output data output from each of the two or more classifiers.

One or more of the ate least one controller may be configured to, in response to the plurality of material detection processes being performed, identify the material of the laundry based on the plurality of pieces of input data, and determine a process condition related to at least one of a washing process, a rinse process, or a spin-dry process based on the identified material of the laundry.

One or more of the at least one controller may be configured to perform the washing process based on the plurality of material detection processes, generate input data based on the value of the drive current detected during the washing process, and additionally identify the material of the laundry, accommodated in the drum, based on the generated input data.

According to an example embodiment of the disclosure a method of controlling a washing machine including a drum, a motor configured to rotate the drum, a motor driver comprising circuitry configured to supply a drive current to the motor, a current sensor configured to detect the drive current, a water supplier comprising a conduit configured to supply water to the drum, the method including: controlling the water supplier to perform a plurality of water supply processes; controlling the motor driver to perform a plurality of material detection processes; generating a plurality of pieces of input data based on a value of the drive current detected during the plurality of material detection processes; and identifying a material of laundry, accommodated in the drum, based on the plurality of pieces of input data, wherein the performing of the plurality of material detection processes may include performing one of the plurality of material detection processes in response to one of the plurality of water supply processes.

The plurality of pieces of input data may include at least one of data about a frequency component of the drive current detected during the plurality of material detection processes and data about an alignment pattern in which the drive current is aligned in order of magnitude.

The identifying of the material may include using a classifier pre-trained by machine learning, and the classifier may be configured to output output data indicating the material of the laundry accommodated in the drum, in response to the plurality of pieces of input data being input.

The method may further include determining a number of the plurality of water supply processes based on a weight of the laundry accommodated in the drum.

The performing of the plurality of water supply processes may include cancelling a water supply process, in response to a water supply time or an amount of water supply for one of the plurality of water supply processes satisfying a specified condition.

The performing of the plurality of material detection processes may include controlling the motor driver to rotate the drum at a constant speed.

The classifier may be configured to include two or more classifiers pre-trained by two or more processes among the plurality of material detection processes and the plurality of weight detection processes identifying a weight of the laundry before supplying water to the drum.

The identifying of the material may include identifying the material of the laundry, accommodated in the drum, based on output data output from each of the two or more classifiers.

The method may further include determining a process condition related to at least one of a washing process, a rinse process, or a spin-dry process based on the identified material of the laundry.

The method may further include performing the washing process based on the plurality of material detection processes, generating input data based on the value of the drive current detected during the washing process, and additionally identifying the material of the laundry, accommodated in the drum, based on the generated input data.

According to an example embodiment of the disclosure, a washing machine and a control method thereof may perform water supply processes in stages and perform a material detection process each time each of the water supply processes is completed, thereby improving an accuracy of identifying a material of laundry.

In addition, by performing a material detection process using a motor current value in a frequency domain, a material of laundry may be identified using data obtained while a drum rotates at a constant speed.

Furthermore, an accuracy of identifying a material of laundry may be improved using a plurality of classifiers which are trained by machine learning and reflect characteristics of each of a plurality of processes.

BRIEF DESCRIPTION OF THE DRAWINGS

The above and other aspects, features and advantages of certain embodiments of the present disclosure will be more apparent from the following detailed description, taken in conjunction with the accompanying drawings, in which:

FIG. 18 is a table illustrating example stages of water supply process performed by a washing machine matched with weights of laundry according to various embodiments;

DETAILED DESCRIPTION

Figure 1:
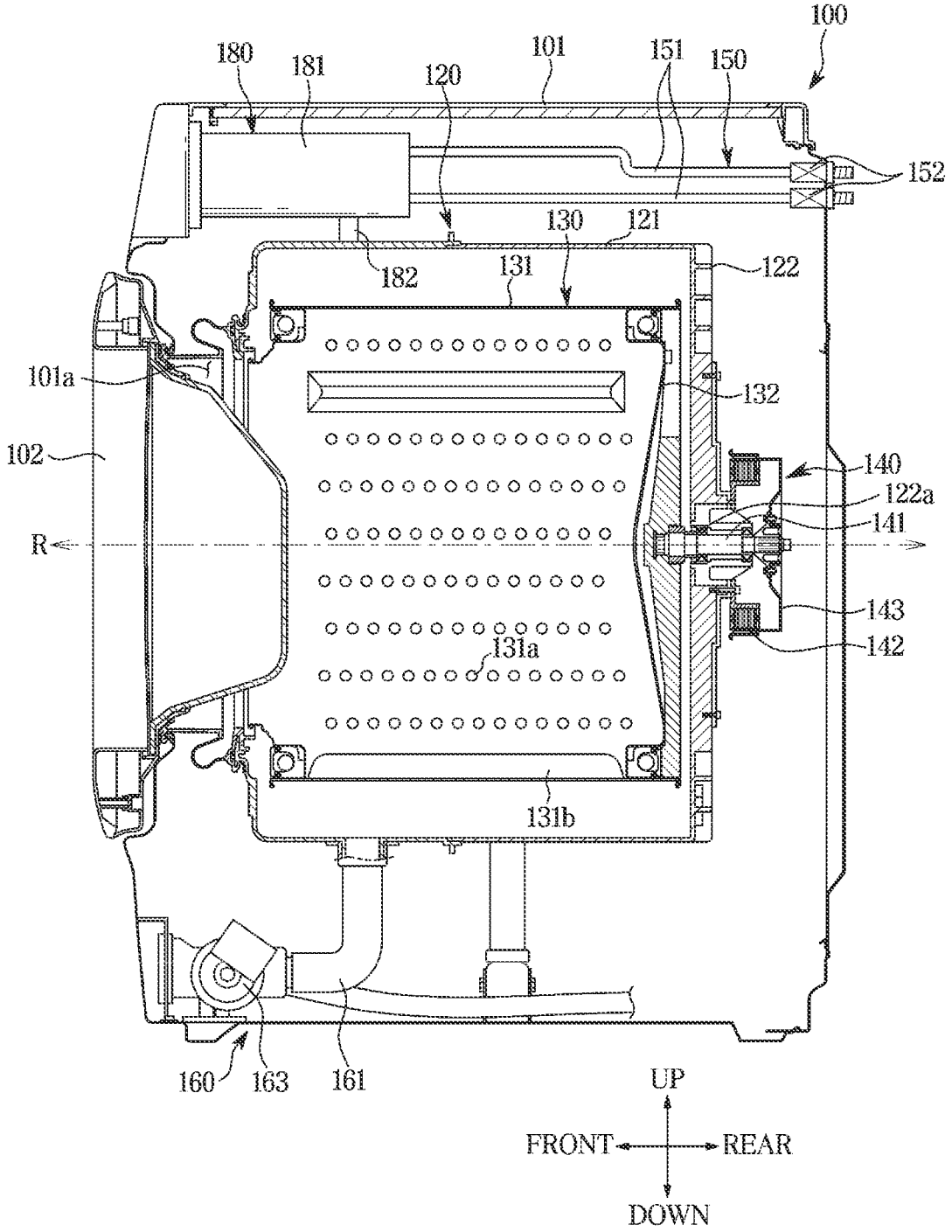
FIG. 1 and FIG. 2 are side cross-sectional views illustrating an example configuration of a washing machine according to various embodiments.

Like reference numerals throughout the disclosure denote like elements. Also, this disclosure may not describe all the elements according to various example embodiments of the disclosure, and descriptions well-known in the art to which the disclosure pertains or overlapped portions may be omitted. The terms such as "—part", "—member", "—module", "—block", and the like may refer to at least one process processed by at least one hardware or software. According to embodiments, a plurality of "—part", "—member", "—module", "—block" may be embodied as a single element, or a single of "—part", "—member", "—module", "—block" may include a plurality of elements.

Throughout the disclosure, it will be understood that when an element is referred to as being "connected" to another element, it may be directly or indirectly connected to the other element, wherein the indirect connection includes "connection" via a wireless communication network.

In addition, it will be understood that the term "include" when used in this disclosure, does not preclude the presence or addition of one or more other elements, unless the context clearly dictates otherwise.

Throughout the disclosure, it will also be understood that when a certain component is referred to as being "on" or "over" another component, it may be directly on the other component or intervening components may also be present.

It will be understood that, although the terms first, second, etc. may be used herein to describe various elements, these elements should not be limited by these terms.

It will be understood that the singular forms are intended to include the plural forms as well, unless the context clearly dictates otherwise.

Reference numerals used for method steps are simply used for convenience of explanation, but not to limit an order of the steps. Thus, unless the context clearly dictates otherwise, the written order may be practiced otherwise.

Hereinafter, various example embodiments of the disclosure will be described in greater detail with reference to the accompanying drawings.

Figure 2:
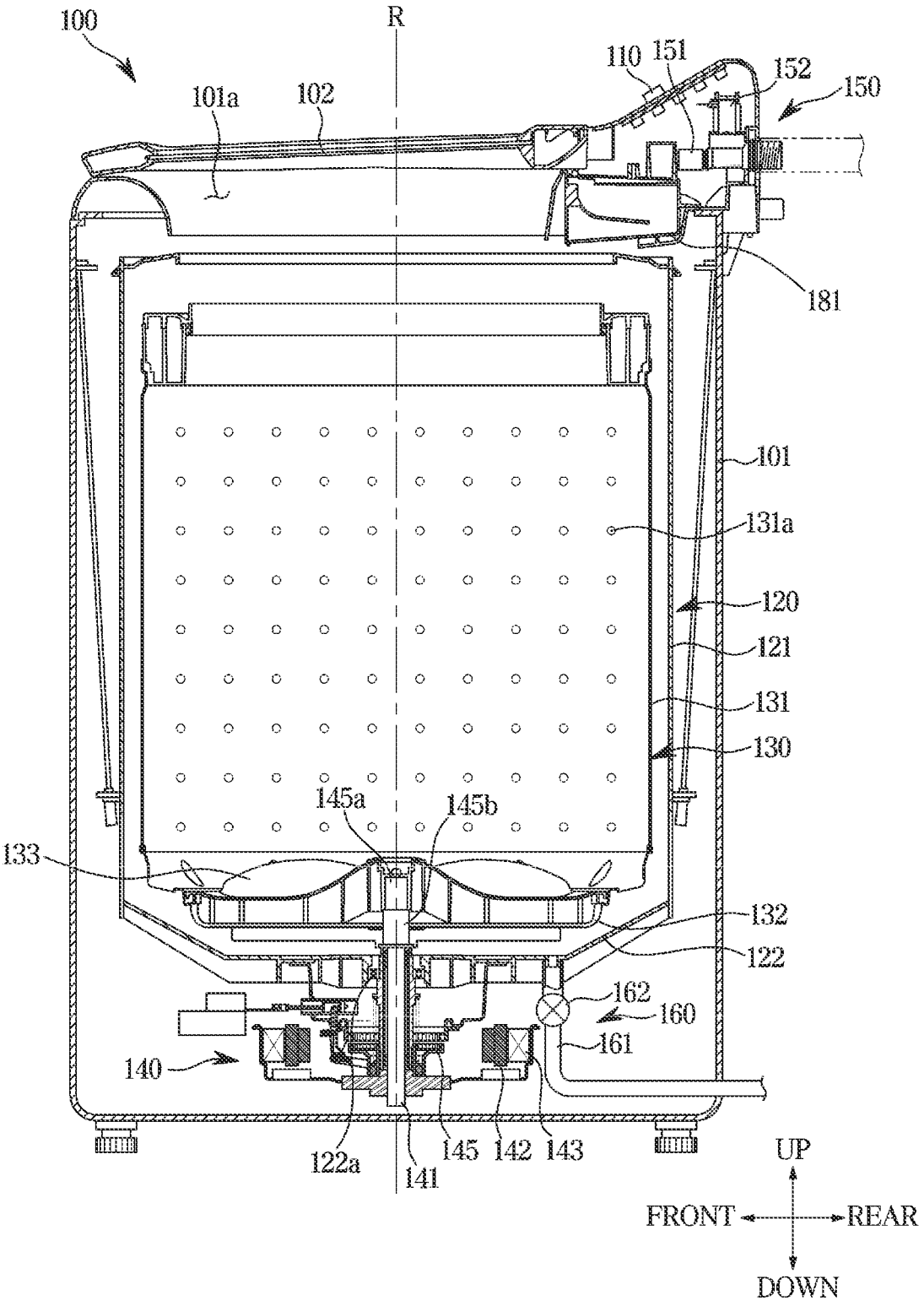

FIG. 1 and FIG. 2 are side cross-sectional views of a washing machine according to various embodiments.

A washing machine 100 according to an embodiment may include a front-loading washing machine in which an inlet 101*a* for putting into or taking out laundry is provided on a front side of the washing machine 100, as shown in FIG. 1, and a top-loading washing machine in which an inlet 101*a* is provided on a top side of the washing machine 100, as shown in FIG. 2. That is, the washing machine 100 according to an embodiment may be the front-loading washing machine or the top-loading washing machine.

Referring to FIG. 1 and FIG. 2, a door 102 capable of opening and closing the inlet 101*a* is provided on one side of a cabinet 101. The door 102 may be provided on the same side as the inlet 101*a*, and may be rotatably mounted on the cabinet 101 by a hinge.

A tub 120 may be provided inside the cabinet 101. The tub 120 may accommodate water for washing or rinsing laundry.

The tub 120 may include a tub bottom surface 122, which is approximately circular, and a tub side wall 121 provided along a circumference of the tub bottom surface 122. An opening may be formed on a surface of the tub 120 facing a bottom surface of the tub 120 to allow laundry to be put in or taken out.

For the front-loading washing machine, as shown in FIG. 1, the tub 120 may be disposed to allow the tub bottom surface 122 to face a rear of the washing machine and to allow a central axis R of the tub side wall 121 to be approximately parallel to the bottom.

For the top-loading washing machine, as shown in FIG. 2, the tub 120 may be disposed to allow the tub bottom surface 122 to face the bottom of the washing machine and to allow the central axis R of the tub side wall 121 to be approximately orthogonal to the bottom.

A drum 130 may be rotatably provided inside the tub 120. The drum 130 may receive power for rotation from a tub motor 140. A bearing 122*a* may be provided on the tub bottom surface 122 to rotatably fix the motor 140.

The drum 130 may accommodate laundry. For example, the drum 130 may have a cylindrical shape with one bottom open. The drum 130 may include a drum bottom surface 132, which is approximately circular, and a drum side wall 131 provided along a circumference of the drum bottom surface 132. An opening may be formed on the other bottom surface of the drum 130 to allow laundry to be put into or taken out.

For the front-loading washing machine, as shown in FIG. 1, the drum 130 may be disposed to allow the drum bottom surface 132 to face a rear of the washing machine and to allow a central axis R of the drum side wall 131 to be approximately parallel to the bottom.

For the top-loading washing machine, as shown in FIG. 2, the drum 130 may be disposed to allow the drum bottom surface 132 to face the bottom of the washing machine and to allow the central axis R of the drum side wall 131 to be approximately orthogonal to the bottom.

The drum side wall 131 may be provided with through holes 131*a* to connect an inside and an outside of the drum 130 to allow water supplied to the tub 120 to flow into the inside of the drum 130.

For the front-loading washing machine, as shown in FIG. 1, a lifter 131*b* is provided on the drum side wall 131 to lift laundry to an upper portion of the drum 130 while the drum 130 rotates.

For the top-loading washing machine, as shown in FIG. 2, a pulsator 133 may be rotatably provided within the drum bottom surface 132. The pulsator 133 may rotate independently of the drum 130. In other words, the pulsator 133 may rotate in the same direction as the drum 130 or in a different direction. The pulsator 133 may also rotate at the same rotational speed as drum 130 or at a different rotational speed.

The drum bottom surface 132 may be connected to a rotation shaft 141 of the motor 140 rotating the drum 130. The motor 140 may generate torque to rotate the drum 130.

The motor 140 is provided outside the tub bottom surface 122 of the tub 120, and may be connected to the drum bottom surface 132 of the drum 130 through the rotation shaft 141. The rotation shaft 141 may pass through the tub bottom surface 122, and may be rotatably supported by the bearing 122*a* provided in the tub bottom surface 122.

The motor 140 may include a stator 142 fixed to an outer side of the tub bottom surface 122, and a rotor 143 rotatable with respect to the tub 120 and the stator 142. The rotor 143 may be connected to the rotation shaft 141.

The rotor 143 may rotate through magnetic interaction with the stator 142, and rotation of the rotor 143 may be transmitted to the drum 130 through the rotation shaft 141.

The motor 140 may include, for example, a Permanent Magnet Synchronous Motor (PMSM) or a Brushless Direct Current (BLDC) motor whose rotational speed is easily controlled.

For the top-loading washing machine, as shown in FIG. 2, a clutch 145 may be provided to transmit torque of the motor 140 to both the pulsator 133 and the drum 130 or to the pulsator 133. The clutch 145 may be connected to the rotation shaft 141. The clutch 145 may distribute the rotation of the rotation shaft 141 to an inner shaft 145*a* and an outer shaft 145*b*.

The inner shaft 145*a* may be connected to the pulsator 133. The outer shaft 145*a* may be connected to the drum bottom surface 132. The clutch 145 may transmit the rotation of the rotation shaft 141 to both the pulsator 133 and the drum 130 through the inner shaft 145*a* and the outer shaft 145*b*, or may transmit the rotation of the rotation shaft 141 to only the pulsator 133 through the inner shaft 145*a*.

A water supplier 150 may supply water to the tub 120 and the drum 130. The water supplier 150 includes a water supply conduit 151 connected to an external water supply source to supply water to the tub 120, and a water supply valve 152 provided on the water supply conduit 151.

The water supply conduit 151 is provided above the tub 120 and may extend from an external water supply source to a detergent box 156. Water is guided to the tub 120 via the detergent box 156.

The water supply valve 152 may allow or block supply of water from the external water supply source to the tub 120 in response to an electrical signal. The water supply valve 152 may include, for example, a solenoid valve opened and closed in response to an electrical signal.

A detergent supply device 180 may supply detergent to the tub 120 and the drum 130. The detergent supply device 180 includes the detergent box 181 provided on an upper side of the tub 120 to store detergent, and a mixing conduit 182 connecting the detergent box 181 to the tub 120.

The detergent box 181 is connected to the water supply conduit 151, and water supplied through the water supply conduit 151 may be mixed with the detergent in the detergent box 181. The mixture of detergent and water may be supplied to the tub 120 through the mixing conduit 182.

A drain 160 may discharge water in the tub 120 or the drum 130 to the outside. The drain 160 may include a drain conduit 161 provided below the tub 120 and extending from the tub 120 to an outside of the cabinet 101.

For the front-loading washing machine, as shown in FIG. 1, the drain 160 may further include a drain pump 163 provided on the drain conduit 161.

For the top-loading washing machine, as shown in FIG. 2, the drain 160 may further include a drain valve 162 provided in the drain conduit 161.

A water level sensor 172 (refer to FIG. 3) may be installed at an end of a connection hose connected to a lower portion of the tub 120. In this instance, a water level of the connection hose may be the same as or similar to that of the tub 120. As the water level in the tub 120 rises, the water level of the connection hose increases, and as the water level of the connection hose rises, a pressure inside the connection hose may increase.

The structures described with reference to FIG. 1 and FIG. 2 are only an example applicable to the washing machine 100 according to an embodiment, and the washing machine 100 according to an embodiment may have a structure partially different from the above-described structures.

Figure 3:
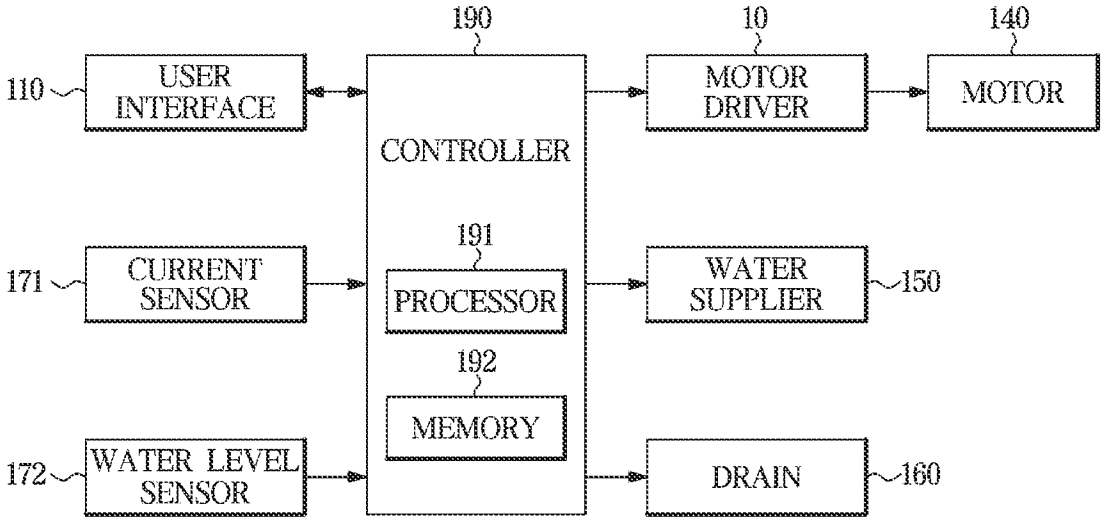
FIG. 3 is a block diagram illustrating an example configuration of a washing machine according to various embodiments.
Figure 4:
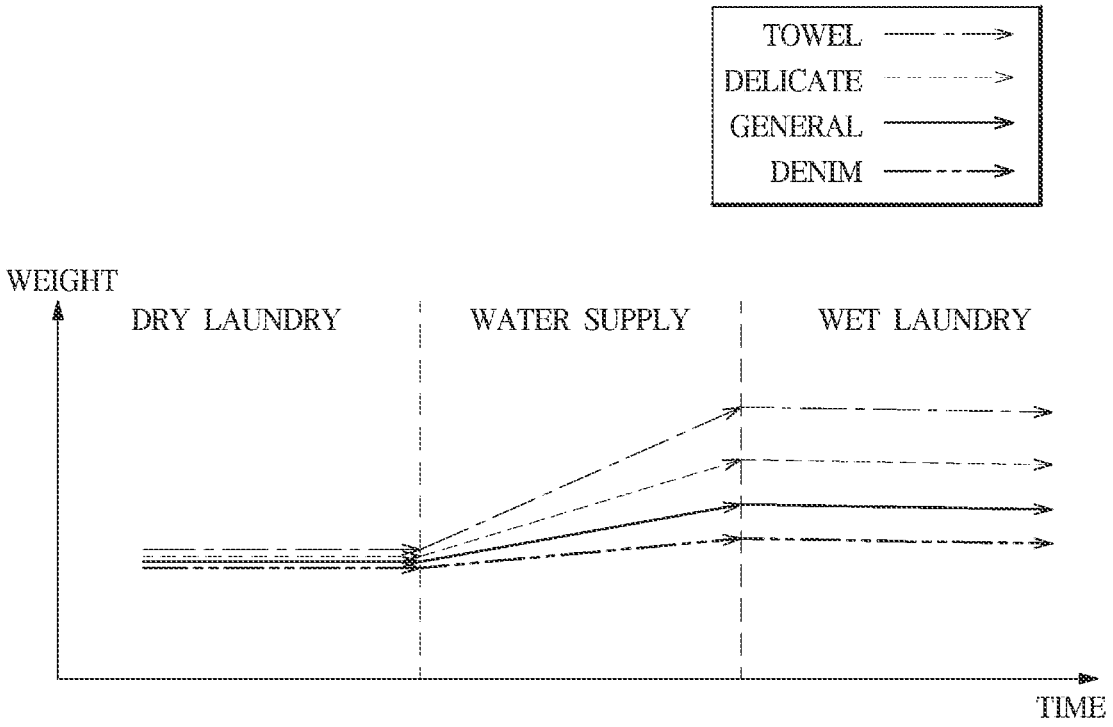
FIG. 4 is a graph illustrating changes in weight of wet laundry that vary depending on a material of laundry according to various embodiments.

FIG. 3 is a block diagram illustrating an example configuration of a washing machine according to various embodiments. FIG. 4 is a graph illustrating changes in weight of wet laundry that vary depending on a material of laundry according to various embodiments.

Referring to FIG. 3, in addition to the above-described water supplier 150, the drain 160, and the motor 130 rotating the drum 130, the washing machine 100 according to an embodiment includes a motor driver (e.g., including driving circuitry) 10 supplying a drive current to the motor 140, a current sensor 171 detecting the drive current of the motor 140, the water level sensor 172 detecting a water level of the drum 130, a user interface 110, and a controller (e.g., including various processing/control circuitry) 190 providing overall control of operation of the washing machine 100.

For example, the motor driver 10 may include a rectifier circuit, a Direct Current (DC) link circuit, and an inverter circuit. The rectifier circuit may include a diode bridge including a plurality of diodes, and may rectify Alternating Current (AC) power from an external power source. The DC link circuit may include a DC link capacitor storing electrical energy, remove a ripple of the rectified power, and output DC power.

The inverter circuit may include a plurality of switching element pairs, convert DC power of the direct current link circuit into DC or AC driving power, and supply the drive current to the motor 140.

The current sensor 171 may measure a current output from the inverter circuit, and transmit an electrical signal corresponding to the measured current to the controller 190.

The water level sensor 172 may be installed at an end of a connection hose connected to a lower portion of the tub 120. In this instance, a water level of the connection hose may be the same as or similar to that of the tub 120. As a water level in the tub 120 rises, the water level of the connection hose increases, and as the water level of the connection hose rises, a pressure inside the connection hose may increase.

The water level sensor 172 may measure the pressure inside the connection hose and transmit an electrical signal corresponding to the measured pressure to the controller 190. The controller 190 may identify the water level of the connection hose, e.g., the water level of the tub 110, based on the pressure of the connection hose measured by the water level sensor 172.

The user interface 110 may include various circuitry and receive a user input for selecting a power on/off of the washing machine 100, for selecting a start/stop of an operation of the washing machine 100, selecting a wash course, or selecting an process execution time or wash intensity of the washing machine 100.

In addition, various information to guide the above-described user input may be displayed, information about a currently ongoing process may be displayed, or information about a state of the washing machine 100 may be displayed.

The user interface 110 may separately include an inputter for receiving a user input and a display for displaying information, or may include a touch screen simultaneously performing functions of the inputter and the display.

The controller 190 may include various processing/control circuitry (as used herein, including the claims, the term "controller" and/or "processor" may include various processing/control circuitry, including at least one processor/controller, wherein one or more processors/controllers of the at least one processor/controller may be configured to perform the various functions described herein) and control an operation of the washing machine 100 according to the user input received by the user interface 110, and may use outputs of the current sensor 171 and the water level sensor 172 to control the operation of the washing machine 100.

The controller 190 includes at least one memory 192 storing programs for performing the above-described operations and operations to be described below, and at least one processor 191 executing the stored programs. As set forth above, the processor may include various processing circuitry (as used herein, including the claims, the term "processor" may include various processing circuitry, including at least one processor, wherein one or more processors of the at least one processor may be configured to perform the various functions described herein).

For example, the controller 190 may control the water supplier 150 to supply water to the drum 130 and control the motor driver 10 to rotate the drum 130, thereby performing washing according to a wash course selected by a user and performing a washing process, a rinse process, and a spin-dry process. Alternatively, according to the user's selection, the washing process may be skipped and only the rinse process and the spin-dry process may be performed.

Among process conditions applied in performing the above-described processes, the amount of water supply may be set based on a weight of laundry, and a wash time, driving rate, alternating rotation pattern, the number of rinses, spin speed, and the like may be set differently depending on a material of the laundry to maximize and/or improve a washing effect while minimizing and/or reducing damage to the fabric of the laundry.

The weight of the laundry may be identified based on a current value of the motor 140 obtained during the rotation of the drum 130. Here, the current value of the motor 140 represents a drive current of the motor 140 detected by the current sensor 171.

A degree in which water is contained, e.g., moisture content, varies depending on the material of the laundry. Accordingly, as shown in FIG. 4, even though water is supplied to the same water level for laundry of the same weight measured in a dry state, weights measured in a wet laundry state after water supply may vary depending on the material of the laundry.

For example, a material such as a towel has a high moisture content, while a material such as denim has a low moisture content. Accordingly, despite water supplied to the same water level for laundry of the two materials, more water is actually supplied to the towel, and the weight of the towel in the wet state is measured higher.

Thus, the controller 190 may perform a material detection process to detect a drive current of the motor 140 while rotating the drum 130 after water supply, and identify the material of the laundry based on a current value of the motor 140 obtained during the material detection process.

In an embodiment, information required to identify the material of the laundry may be obtained during the material detection process, but identifying the material using the obtained information is not necessarily required to be performed during the material detection process. That is, in the embodiment, the material detection process may refer to a process performed to detect information used to identify a material. A weight detection process may also refer to a process performed to detect information used to identify a weight.

The washing machine 100 according to an embodiment may use a classifier (e.g., including various processing circuitry and/or executable program instructions) pre-trained by machine learning in identifying a material of laundry. A method of training the classifier is described in greater detail below.

The classifier identifying a material of laundry may be trained based on a machine learning model or a deep learning model which is a type of machine learning. For example, at least one of various neural networks such as, for example, and without limitation, Artificial Neural Network (ANN), Deep Neural Network (DNN), Convolution Neural Network (CNN), Recurrent Neural Network (RNN), or the like, may be used to train the classifier.

Training data used for training the classifier may include input data and expected output data. The input data may be data about a current value of the motor obtained during the material detection process or another process, and the expected output data may be data about the material of the laundry.

In response to the data about the current value of the motor being input to the machine learning model, the data about the material of the laundry may be output through a hidden layer. The classifier may be trained by calculating a loss value representing a difference between the output data and the expected output data and adjusting a weight of the hidden layer in a direction to minimize and/or reduce the loss value.

The classifier for which learning has been completed may be stored in the controller 190, and the controller 190 may input the data about the current value of the motor 140 obtained while the washing machine 100 is in use to the classifier, thereby inferring the material of the laundry.

The above-described classifier may be trained and stored in a manufacturing stage of the washing machine 100. In addition, the classifier may be updated even after the washing machine 100 is sold. For example, the classifier may be updated by connecting to an external server through a communication device provided in the washing machine 100, and the controller 190 may re-train the classifier by itself using the data obtained while the washing machine 100 is in use.

Hereinafter, the data input to the classifier during the training and use of the classifier is described in greater detail.

Figure 5:
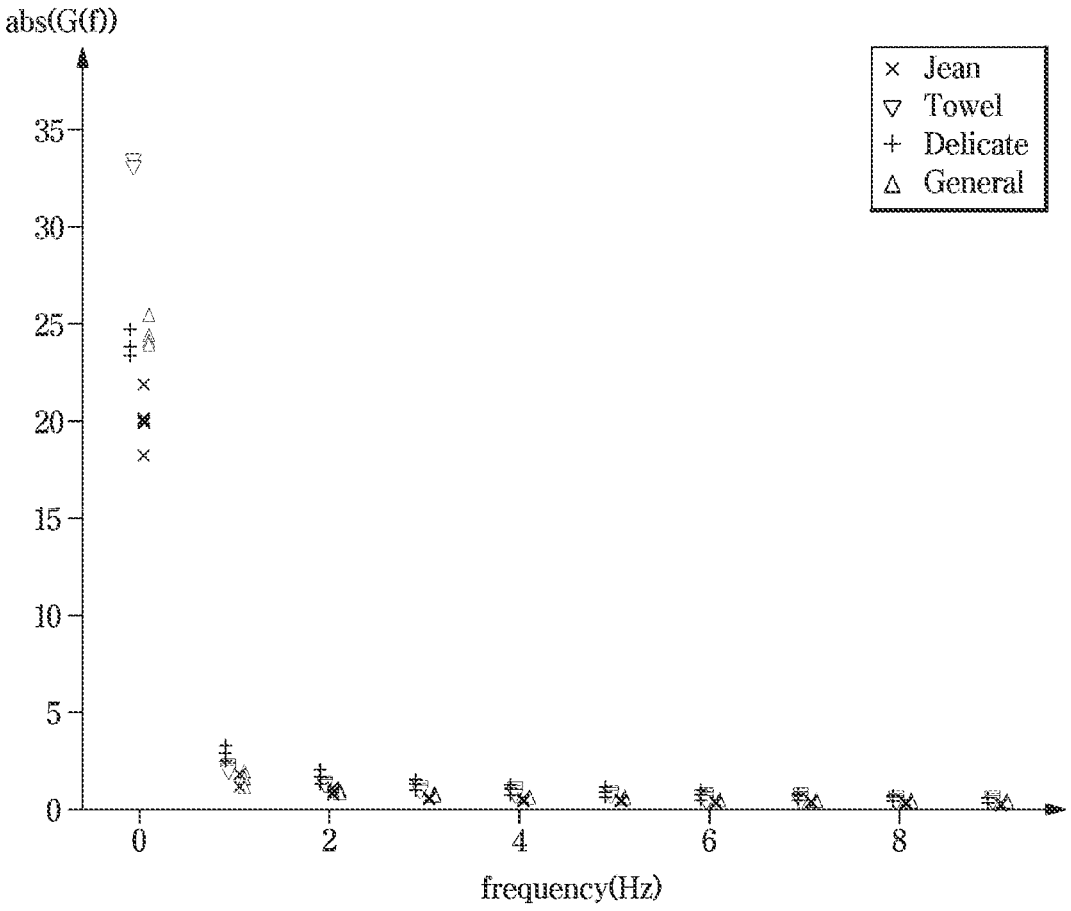
FIG. 5 is a graph illustrating current values of a motor obtained in a material detection process in a frequency domain according to various embodiments.
Figure 6:
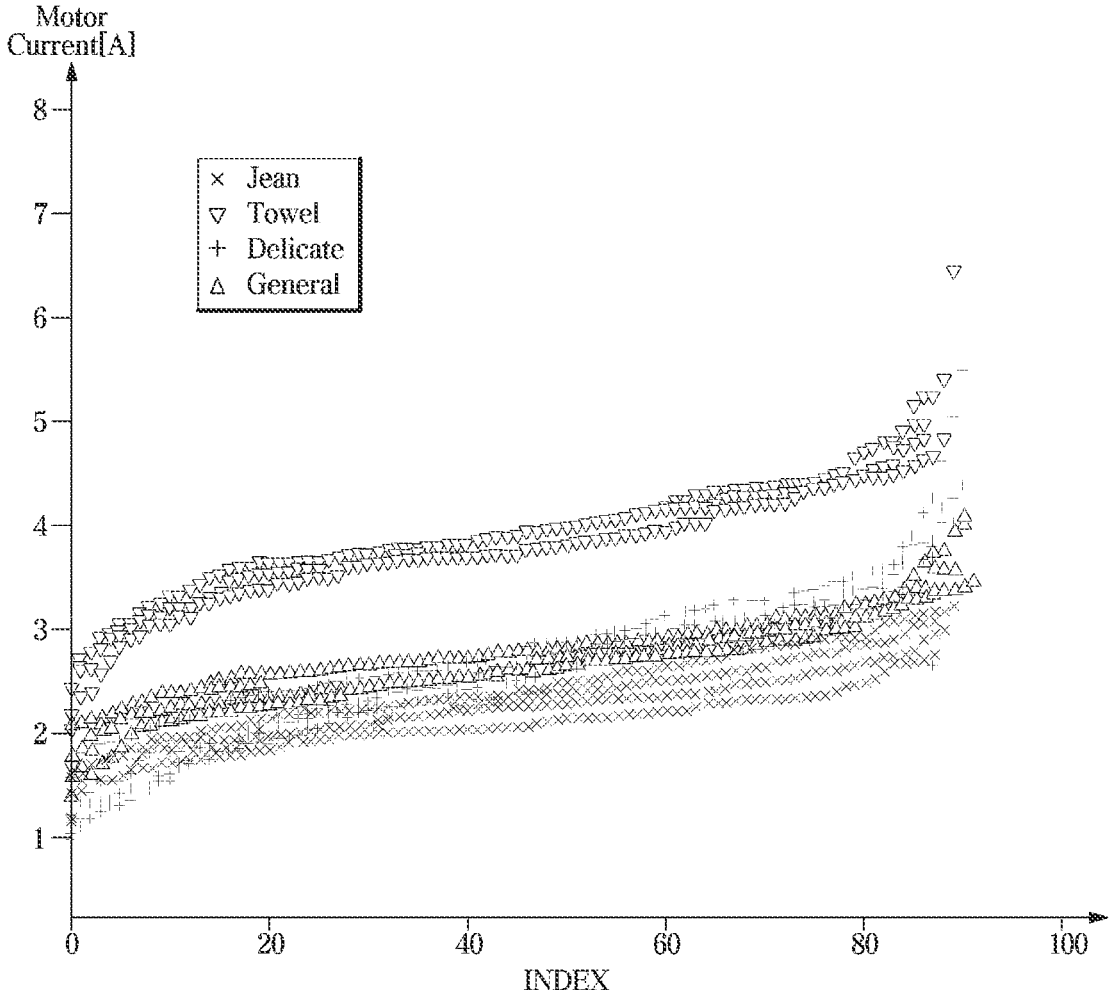
FIG. 6 is a graph illustrating current values of a motor obtained in a material detection process in order of magnitude according to various embodiments.
Figure 7:
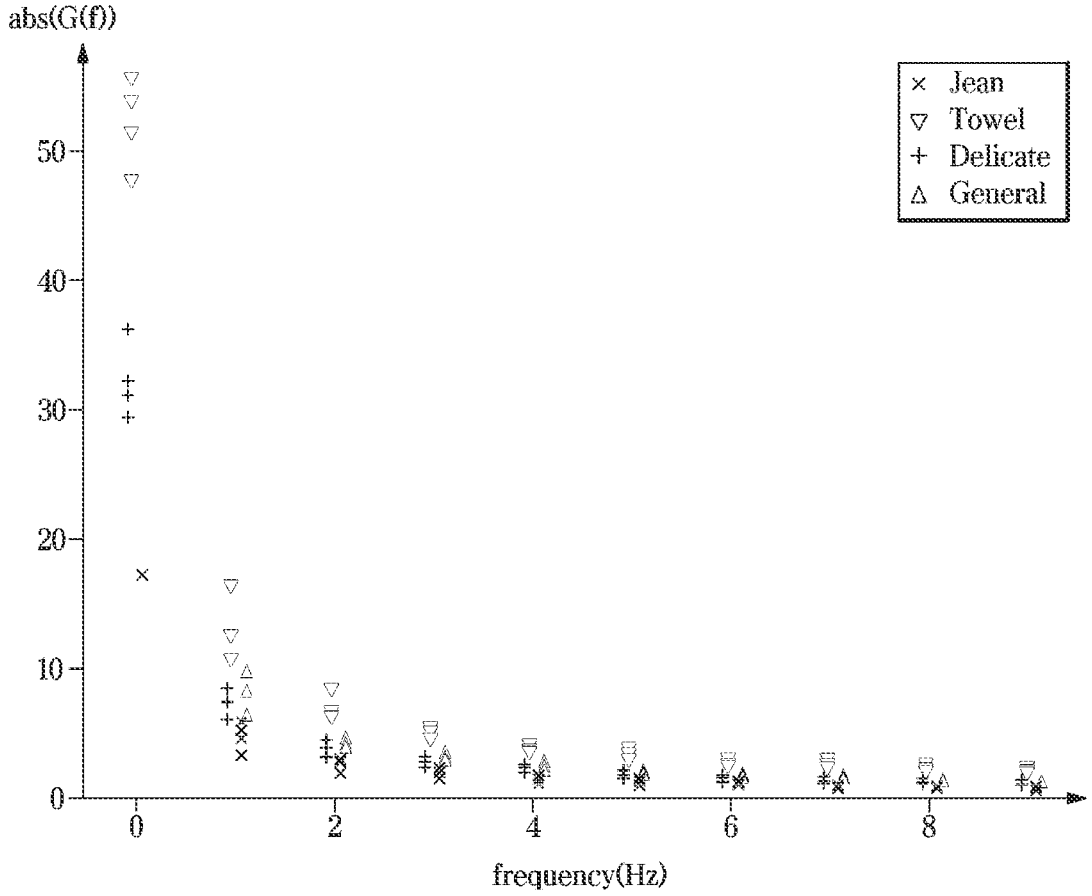
FIG. 7 is a graph illustrating current values of a motor obtained in a water supply process in a frequency domain according to various embodiments.
Figure 8:
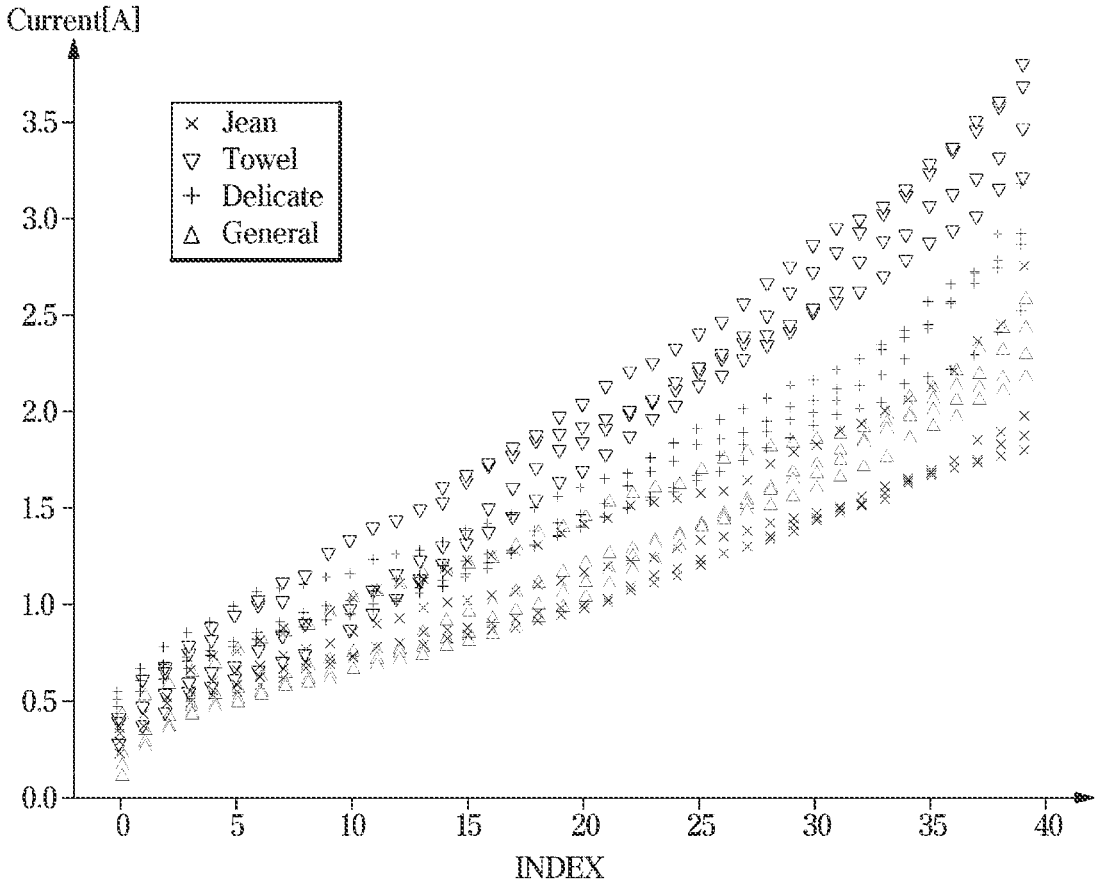
FIG. 8 is a graph illustrating current values of a motor obtained in a water supply process in order of magnitude according to various embodiments.

FIG. 5 is a graph illustrating current values of a motor obtained in a material detection process in a frequency domain according to various embodiments. FIG. 6 is a graph illustrating current values of a motor obtained in a material detection process in order of magnitude according to various embodiments. FIG. 7 is a graph illustrating current values of a motor obtained in a water supply process in a frequency domain according to various embodiments. FIG. 8 is a graph illustrating current values of a motor obtained in a water supply process in order of magnitude according to various embodiments.

In the graphs of FIG. 5 and FIG. 6, x indicates data obtained for denim, ▼ indicates data obtained for a towel, + indicates data obtained for delicate clothes, and ▲ indicates data obtained for general clothes. The delicate clothes refer to clothes made of silk or functional materials such as lingerie, and general clothes refers to clothes made of cotton materials such as T-shirts or cotton pants.

Current values of a motor in a time domain are often not clearly distinguished depending on a material of laundry. However, as shown in FIG. 5, in a case where changes in motor current values are obtained in a frequency domain, it may be confirmed that denim and a towel are clearly distinguished in a 0 Hz component, and delicate clothes and general clothes are clearly distinguished in 1 to 2 Hz components.

In addition, referring to FIG. 6, in a case where current values of the motor are aligned in order of magnitude for each material, it may be confirmed that alignment patterns vary depending on the material of the laundry.

Accordingly, the washing machine 100 according to an embodiment may use, as input data of a classifier, at least one of data about frequency components of current values of the motor 140 or data about the alignment patterns in which the current values of the motor are aligned in order of magnitude.

By performing training and classification using the above-described input data, the drum 130 is not required to be accelerated to maximize and/or increase a difference in current characteristics of the motor for each material of the laundry, and materials of the laundry may be distinguished using data obtained by rotating the drum 130 at a constant speed as in other general processes such as a washing process or rinse process.

Meanwhile, even during a water supply process, a current value of the motor 140 may be obtained by rotating the drum 130 at a constant speed. Referring to FIG. 7, it may be confirmed that current value patterns of the motor 140 obtained during the water supply process also show a clear difference between materials in the frequency domain. Referring to FIG. 8, it may be confirmed that alignment patterns in which current values of the motor 140 obtained during the water supply process are aligned in order of magnitude also show a clear difference between materials.

In addition, comparing FIG. 5 and FIG. 7, it may be confirmed that there is a difference between the frequency component pattern of the current values of the motor 140 obtained during a material detection process and the frequency component pattern of the current values of the motor 140 obtained during the water supply process. Comparing FIG. 6 and FIG. 8, it may be confirmed that there is a difference between the alignment pattern of the current values of the motor 140 obtained during the material detection process and the alignment pattern of the current values of the motor 140 obtained during the water supply process.

For example, because a driving RPM of the drum 130, driving time, the amount of water supply, how wet the laundry is, and the like are different for each process performed by the washing machine 100, the current value characteristics of the motor 140 are also different. Accordingly, using data obtained from a plurality of different processes in training a classifier stored in the washing machine 100 according to an embodiment, an accuracy of classification may be improved.

The classifier stored in the washing machine 100 may include a single classifier or a plurality of classifiers. In addition, the single classifier or each of the plurality of classifiers may be a single-process classifier trained for a single process, or may be a multiple-process classifier trained for a plurality of processes.

The single-process classifier may refer, for example, to a classifier trained using data obtained by a single process, and the multiple-process classifier refers to a classifier trained using data obtained by a plurality of processes.

For example, a case where a single-process classifier is generated for each process is described. Input data may be generated based on current values of the motor 140 obtained during each process, and a machine learning model may be trained using the generated input data. The input data may be data about frequency components of the current values of the motor 140, may be data about an alignment pattern aligned in order of magnitude, or may be data concatenating both. Thereafter, the washing machine 100 may also generate input data of the same form and input the generated input data to the classifier to identify the material of the laundry using the classifier.

In a case where the multiple-process classifier is generated, input data may be generated based on current values of the motor 140 obtained during a plurality of processes. A set of input data may be generated by concatenating each input data generated for the plurality of processes, and a machine learning model may be trained using the set of input data. Thereafter, the washing machine 100 may generate input data of the same form and input the generated input data to the multiple-process classifier to identify the material of the laundry using the multiple-process classifier.

Figure 9:
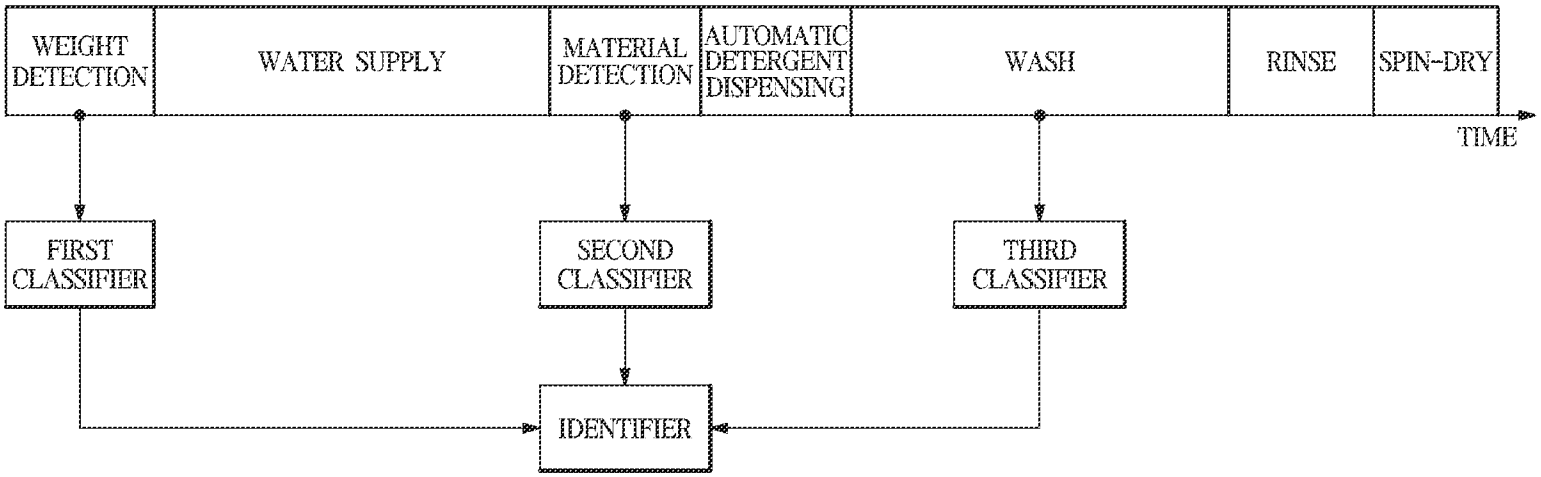
FIG. 9 is a timing chart illustrating an example process of identifying a material of laundry using data obtained during a plurality of processes by a washing machine according to various embodiments.
Figure 10:
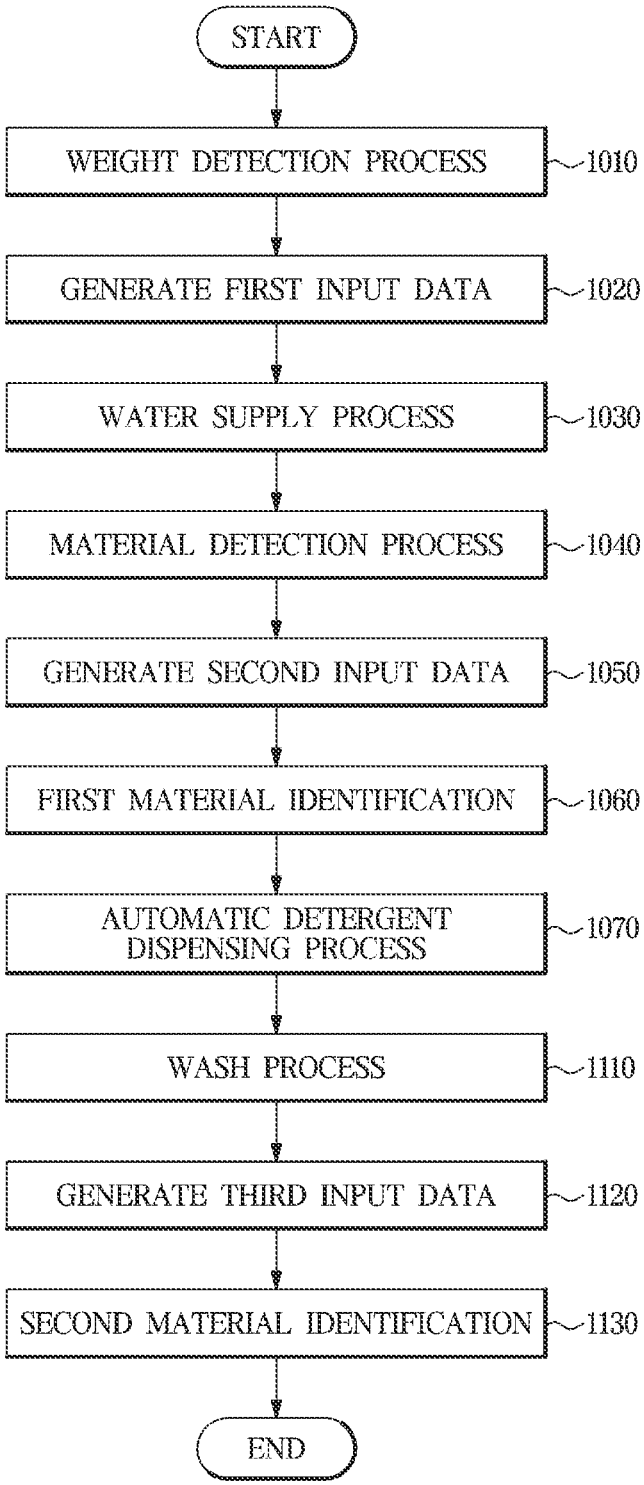
FIG. 10, FIG. 11, and FIG. 12 are flowcharts illustrating examples of the process shown in FIG. 9 according to various embodiments.
Figure 11:
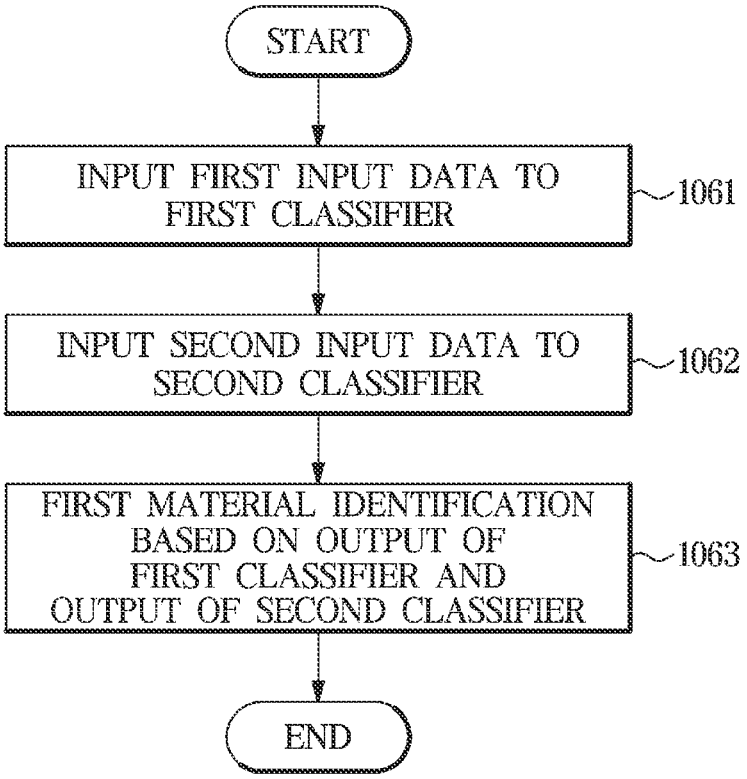
Figure 12:
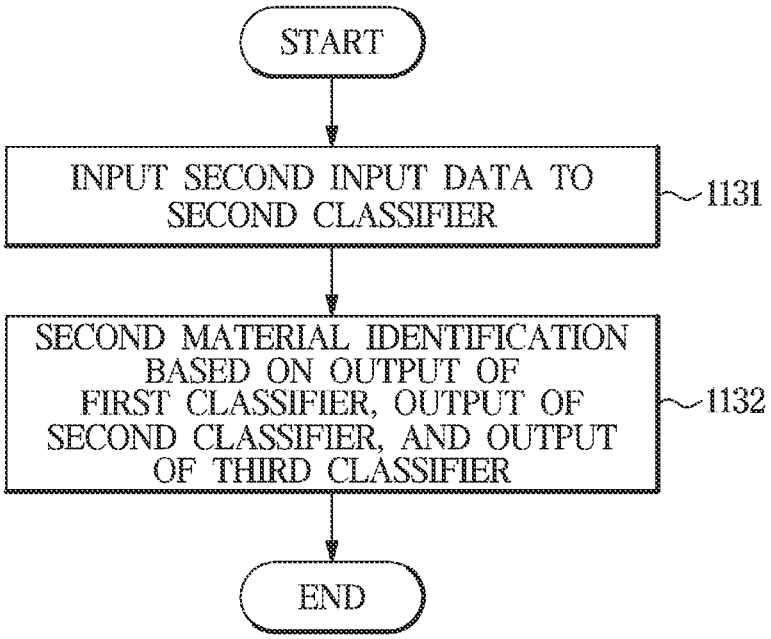

FIG. 9 is a timing chart illustrating an example process of identifying a material of laundry using data obtained during a plurality of processes by a washing machine according to various embodiments. FIG. 10, FIG. 11, and FIG. 12 are flowcharts illustrating examples of the process shown in FIG. 9 according to various embodiments.

In the example of FIG. 9, three classifiers are used to identify a material of laundry, and all the three classifiers are single-process classifiers, but it will be understood that the disclosure is not limited thereto.

The example in FIG. 9 relates to a case where, among wash courses performable in the washing machine 100, a wash course including a weight detection process, a water supply process, a material detection process, an automatic detergent dispensing process, a washing process, a rinse process, and a spin-dry process is performed.

In addition, in the example of FIG. 9, a first classifier for the weight detection process, a second classifier for the material detection process, and a third classifier for the washing process are illustrated by way of non-limiting example and are used to identify the material of the laundry. Here, the ordinal numbers in front of the classifiers are used to distinguish the plurality of classifiers from each other, and in the embodiments to be described below, a different ordinal number may be used for the same classifier.

Referring to the flowchart of FIG. 10 together, the weight detection process (1010) is performed before supplying water to the drum 130.

In the weight detection process, a drive current of the motor 140 may be detected while rotating the drum 130 without water, e.g., the drum 130 accommodating dry clothes, at a constant speed. To this end, the controller 190 may transmit a control signal to the motor driver 10, and the motor driver 10 may rotate the drum 130 by outputting the drive current to the drum 130 based on the transmitted control signal. From the above description based on the control block diagram, it may be clearly understood that the components of the washing machine 100 operate under the control of the controller 190. Accordingly, in the embodiment to be described below, descriptions related to control by the controller 190 may be omitted.

The controller 190 may generate first input data from current values of the motor 140 obtained during the weight detection process (1020). The first input data is input to the first classifier. In the example, because the first classifier is a classifier for the weight detection process, the controller 190 generates the first input data based on the current values of the motor 140 obtained during the weight detection process. However, the ordinal number in front of the input data is used to distinguish a plurality of pieces of input data from each other, and in another example to be described below, the first input data may be input to a classifier other than the first classifier.

A form of input data may be the same as that of input data used in training the classifier. Accordingly, in response to frequency components of the current values of the motor being used to train the classifier, the first input data representing the frequency components of the current values of the motor 140 is generated. Alternatively, in response to an alignment pattern of the current values of the motor being used to train the classifier, the first input data representing the alignment pattern of the current values of the motor 140 is generated.

Meanwhile, the controller 190 may identify a weight of the laundry based on the current values of the motor 140 obtained during the weight detection process. For example, based on the current values of the motor 140, the weight of laundry may be divided into a plurality of stages. Here, the identified weight of the laundry may be used to determine process conditions to be applied to subsequent processes.

The water supply process is performed to supply water to the drum 130 (1030). In this instance, a target water level may be determined based on the weight of the laundry identified in the weight detection process. For example, the target water level may be determined to be a water level at which the laundry may be sufficiently wet. In a case where the washing machine 100 is equipped with an automatic detergent dispensing function, the target water level is a water level after automatic detergent dispensing is completed. Accordingly, the target water level may be determined to allow the laundry to be sufficiently wet, excluding the amount of water to be supplied upon automatic detergent dispensing.

The controller 190 may use an output of the water level sensor 172 to supply water up to the target water level. The controller 190 may confirm the water level based on the output of the water level sensor 172 while supplying water using the water supplier 150, and may stop water supply in response to the output of the water level sensor 172 corresponding to the target water level.

In response to the water supply being completed, the controller 190 rotates the drum 130 at a constant speed to perform the material detection process (1040). For example, the drum 130 may rotate at a speed selected from a range of 30 to 50 Revolutions Per Minute (RPM), but the embodiment of the washing machine 100 is not limited thereto.

The controller 190 generates second input data based on the current values of the motor 140 obtained during the material detection process (1050). The second input data refers to input data to be input to the second classifier. Because the second classifier is a classifier for the material detection process, the controller 190 may generate the second input data of the same form as the input data used in training the second classifier, based on the current values of the motor 140 obtained during the material detection process.

The controller 190 performs a first material identification based on the outputs of the first classifier and the second classifier (1060). The first material identification will be described later.

The controller 190 may determine process conditions to be applied to subsequent processes, based on a result of the first material identification. For example, in a case where the washing machine 100 is equipped with the automatic detergent dispensing function, a type of detergent may be determined based on the material of the laundry identified in the first material identification. In addition, the automatic detergent dispensing process may be performed to automatically dispense the determined type of detergent to the drum 130 (1070). In the automatic detergent dispensing process, detergent and water may be added together.

In response to the detergent being automatically dispensed, the controller 190 rotates the drum 130 to perform the washing process (1110). A driving RPM for rotating the drum 130 may be determined based on a selected wash course or the material of the laundry.

The controller 190 generates third input data based on current values of the motor 140 obtained during the washing process (1120). The third input data refers to input data to be input to the third classifier. Because the third classifier is a classifier for the washing process, the controller 190 may generate the third input data of the same form as the input data used in training of the third classifier, based on the current values of the motor 140 obtained during the washing process.

The controller 190 may perform a second material identification based on the third input data (1130).

Referring to FIG. 11, in order to perform the first material identification (1060 of FIG. 10), the first input data may be input to the first classifier (1061), the second input data may be input to the second classifier (1062), and the first material identification may be performed based on an output of the first classifier and an output of the second classifier (1063).

In order to identify the material of the laundry based on the output of the plurality of classifiers, the controller 190 may include a identifier. For example, the identifier may identify the material of the laundry using a voting method. Weights may be applied to output data of the first classifier and output data of the second classifier, respectively, and the weighted output data may be compared to identify the material. Weights may be applied differently for each classifier, or may be applied equally.

For example, in a case where weights are applied equally to each classifier, in response to the output data of the first classifier and the output data of the second classifier both corresponding to denim, a result of the first material identification may be denim.

For example, in a case where a weight of the first classifier is applied higher than that of the second classifier, in response to the output data of the first classifier and the output data of the second classifier corresponding to a towel and denim, respectively, a result of the first material identification may be a towel.

As described above, in response to a single material being output as a result of the first material identification, the second material identification may be omitted. Alternatively, even though a single material is output as a result of the first material identification, the second material identification may be performed for verification to correct errors.

In the case where weights are applied equally to each classifier, in response to the output data of the first classifier and the output data of the second classifier corresponding to a towel and denim, respectively, a single material may not be output as a result of the first material identification.

In this case, the material identification may be held, and the automatic detergent dispensing process and the washing process may be performed according to default process conditions. The default process conditions may be conditions set to minimize and/or reduce damage to clothes.

Referring to FIG. 12, in order to perform the second material identification (1130 of FIG. 10), the third input data may be input to the third classifier (1131), and the second material identification may be performed based on the output of the first classifier, the output of the second classifier and the output of the third classifier (1132).

As in the first material identification, the second material identification may be performed by applying weights to the output data of each of the classifiers and comparing the weighted output data.

In response to a single material not being identified in the first material identification, a single material may be identified through the second material identification. The controller 190 may change the process conditions based on the material identified through second material identification. In response to a single material not being identified even through second material identification, the default process conditions are maintained.

Alternatively, even though a single material is identified in the first material identification, a different material may be identified in the second material identification. In this case, the controller 190 may also change the process conditions based on the material identified through the second material identification.

Alternatively, the output of the classifier used in the first material identification may not be used in the second material identification. In the example, the second material identification may be performed based only on the output of the third classifier.

Meanwhile, although it is illustrated in the flowcharts of FIG. 11 and FIG. 12 that each input data is input to each of the classifiers after the input data required for material identification is completely generated, each time each input data is generated, the generated input data may be input to the corresponding classifier.

Figure 13:
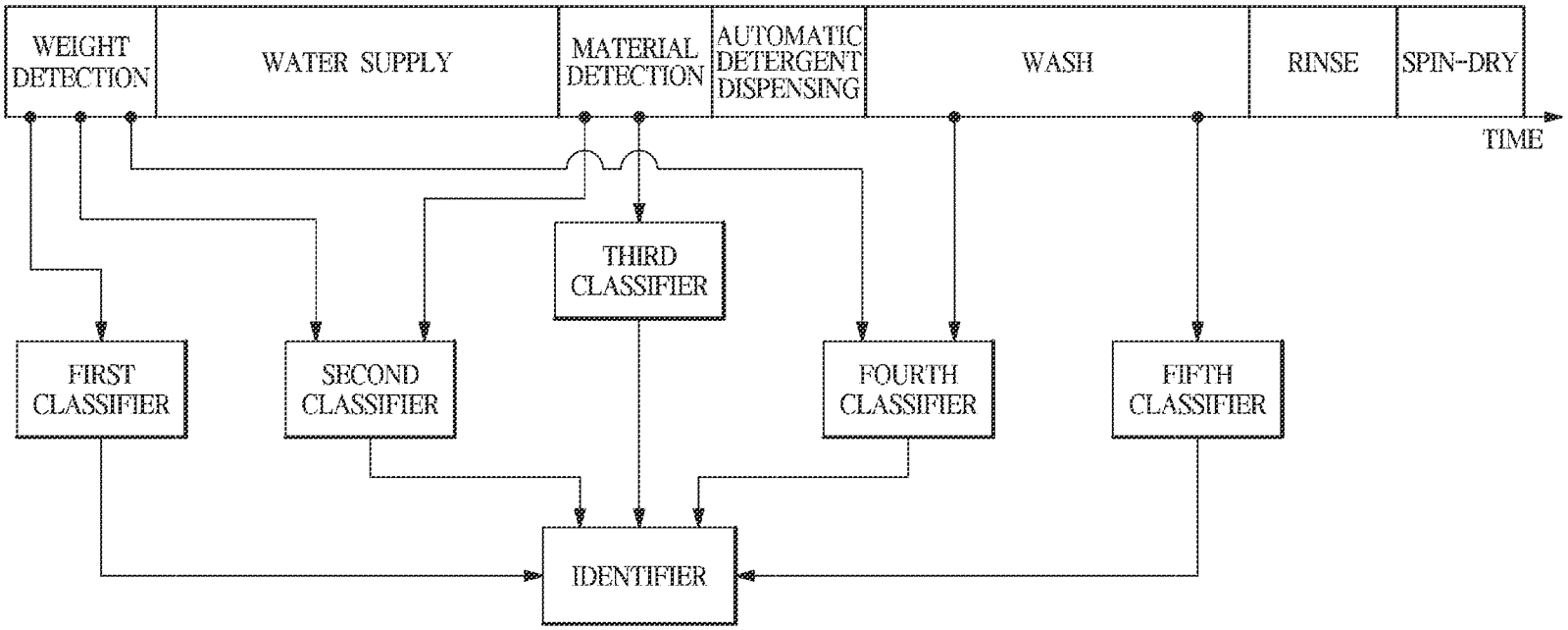
FIG. 13 is a diagram illustrating an example of a process of identifying a material of laundry using data obtained during a plurality of processes by a washing machine according to various embodiments.
Figure 14:
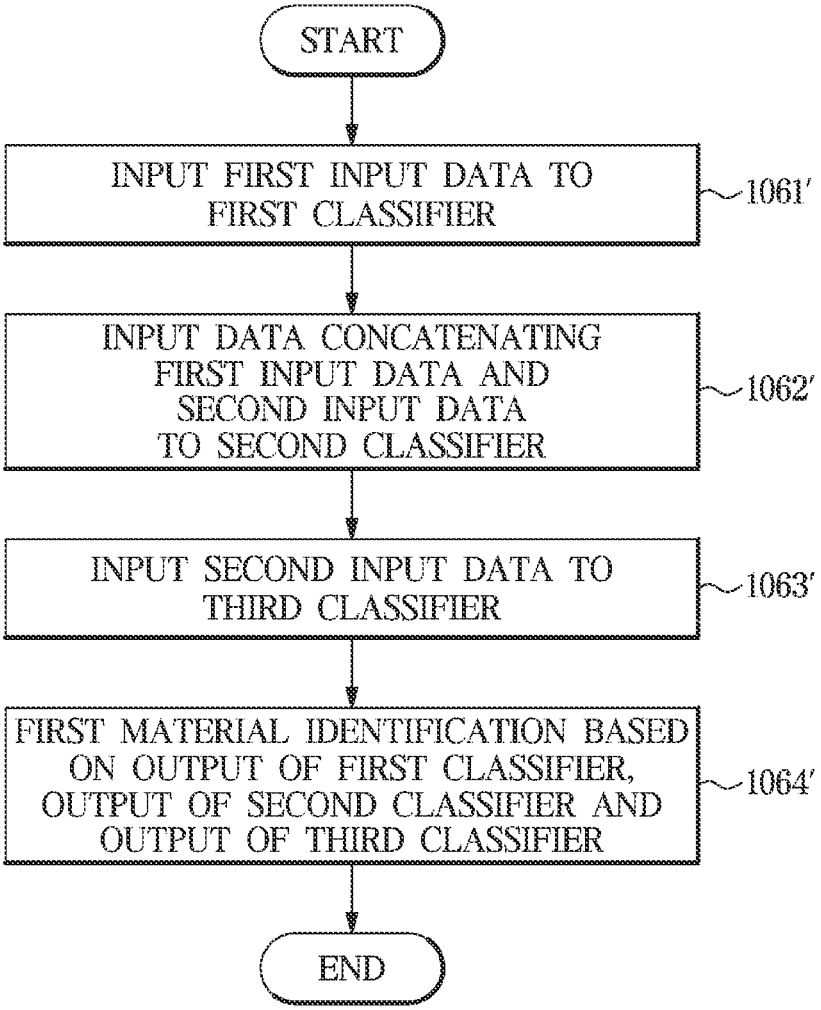
FIG. 14 is a flowchart illustrating an example first material identification in the process of FIG. 13 according to various embodiments.
Figure 15:
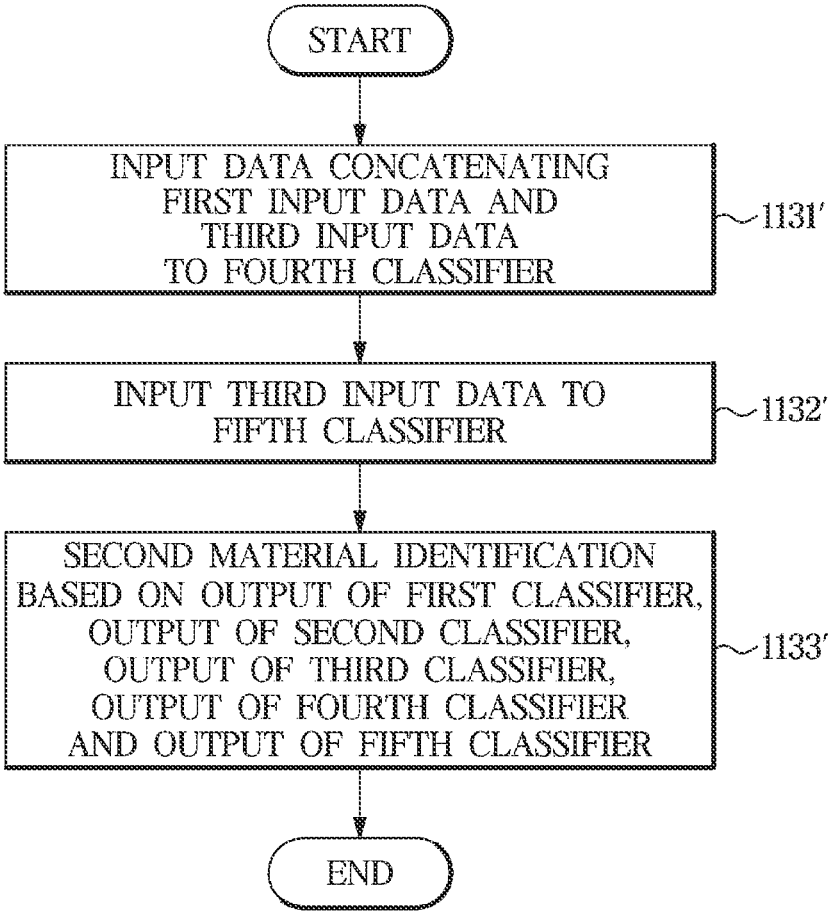
FIG. 15 is a flowchart illustrating an example second material identification in the process of FIG. 13 according to various embodiments.

FIG. 13 is a diagram illustrating an example of a process of identifying a material of laundry using data obtained during a plurality of processes by a washing machine according to various embodiments. FIG. 14 is a flowchart illustrating an example first material identification in the process of FIG. 13 according to various embodiments. FIG. 15 is a flowchart illustrating an example second material identification in the process of FIG. 13 according to various embodiments.

In the non-limiting example of FIG. 13, five classifiers are used to identify a material of laundry, some of the five classifiers are single-process classifiers and the other classifiers are multiple-process classifiers.

The entire process performed in the example of FIG. 13 is the same as or similar to the example of FIG. 9 described above, operations of performing the processes and obtaining the input data in FIG. 13 are the same as or similar to those shown in the flowchart of FIG. 10, and thus a detailed description thereof may not be repeated herein.

As in the above-described example, first input data may be generated using current values of the motor 140 obtained during a weight detection process, second input data may be generated using current values of the motor 140 obtained during a material detection process, and third input data may be generated using current values of the motor 140 obtained during a washing process.

A first material identification performed in the example of FIG. 13 may be performed according to operations illustrated in FIG. 14.

In the example of FIG. 13, a first classifier is a single-process classifier for the weight detection process, and thus the controller 190 inputs the first input data to the first classifier (1061' of FIG. 14).

In the example of FIG. 13, a second classifier is a multiple-process classifier for the weight detection process and the material detection process, and thus the controller 190 may input data concatenating the first input data and the second input data to the second classifier (1062' of FIG. 14).

In the example of FIG. 13, a third classifier is a single-process classifier for the material detection process, the controller 190 inputs the second input data to the third classifier (1063' of FIG. 14).

The identifier of the controller 190 performs the first material identification based on the output of the first classifier, the output of the second classifier, and the output of the third classifier (1064' of FIG. 14). An operation of performing the first material identification through voting by applying a weight to output data of each of the classifiers has been described above with reference to FIG. 11.

A second material identification performed in the example of FIG. 13 may be performed according to operations illustrated in FIG. 15.

In the example of FIG. 13, a fourth classifier is a multiple-process classifier for the weight detection process and the washing process, and thus the controller 190 inputs data concatenating the first input data and the third input data to the fourth classifier (1131' of FIG. 15).

In the example of FIG. 13, a fifth classifier is a single-process classifier for the washing process, and thus the controller 190 inputs the third input data to the fifth classifier (1132' of FIG. 15).

The identifier of the controller 190 performs the second material identification based on the output of the first classifier, the output of the second classifier, the output of the third classifier, the output of the fourth classifier, and the output of the fifth classifier (1033' of FIG. 15).

The operations of performing the second material identification through voting by applying a weight to output data of each of the classifiers, and changing or maintaining process conditions according to a result of the second material identification has been described above with reference to FIG. 12.

Although it has been described in the above example that material identification is performed twice, material identification may be performed three or more times and a classifier for a subsequent process after the washing process may be used.

In such cases, a result of a finally performed material identification may be used to evaluate a performance of classifier or to update the classifier, even though the result is not used to determine a process condition.

Alternatively, the result of the finally performed material identification may be used for a drying operation performed after a wash course is completed. For example, the material identification result may be transmitted to a dryer connected to the washing machine 100.

In addition, as described above, each time each input data is generated, the generated input data may be input to the corresponding classifier. In this case, the identifier may perform material identification in advance based on output of some classifiers, and in response to output data of a predetermined number of classifiers indicating the same material, a subsequent classification may be omitted.

For example, in the example of FIG. 13, in response to output data of the first classifier and the second classifier being input to the identifier in advance, and the output data of the first classifier and the second classifier indicating the same material, the corresponding material may be determined as the material of the laundry, and a material identification using the third classifier may be omitted.

Figure 16:
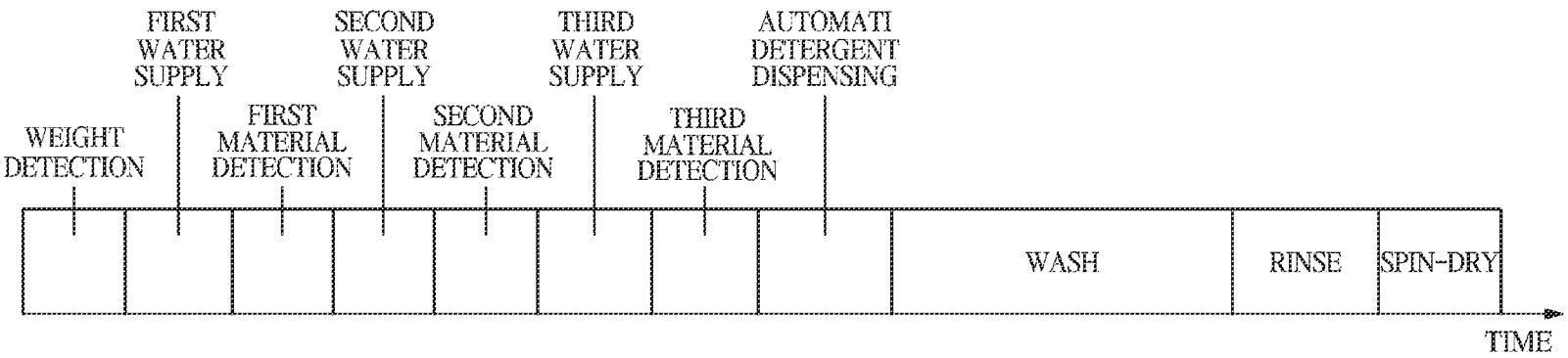
FIG. 16 is a timing chart illustrating an example wash course including water supply processes performed in stages in a washing machine according to various embodiments.
Figure 17:
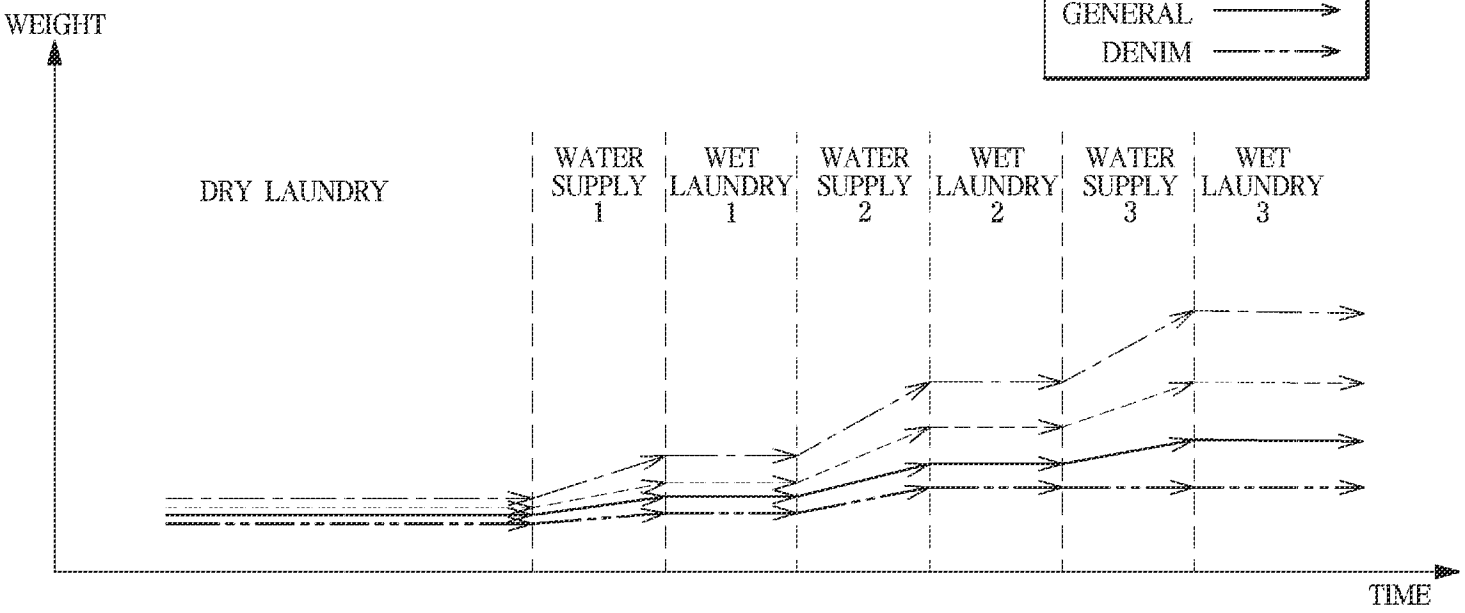
FIG. 17 is a graph illustrating changes in weight of laundry that occur in response to water supply processes being performed in stages according to various embodiments.

FIG. 16 is a timing chart illustrating an example wash course including water supply processes performed in stages in a washing machine according to various embodiments. FIG. 17 is a graph illustrating changes in weight of laundry that occur in response to water supply processes being performed in stages according to various embodiments.

Referring to FIG. 16, the washing machine 100 according to an embodiment may perform water supply processes in stages. That is, the controller 190 may control the water supplier 150 to perform a plurality of water supply processes in stages, and control the motor driver 10 to rotate the drum 130 at a constant speed, thereby performing a plurality of material detection processes. In this case, because a material of laundry is identified using data obtained during the stepwise processes in which the laundry gets wet, an accuracy of material identification may be improved.

For example, in a case where a water supply process is performed N times (N is an integer greater than or equal to 2), a water level may be increased by 1/N compared to a target water level at each of the water supply processes. Alternatively, in a case where the washing machine 100 is equipped with an automatic detergent dispensing function, water is supplied together with detergent upon performing the automatic detergent dispensing function, and thus a water level may be increased by 1/(N+1) compared to a target water level at each of the water supply processes.

The material detection process may be performed in response to each of the plurality of water supply processes. For example, in a case where the water supply process is divided into three stages, a first material detection process may be performed in response to completion of a first water supply process, a second material detection process may be performed in response to completion of a second water supply process, and a third material detection process may be performed in response to completion of a third water supply process.

Each of the first material detection process, the second material detection process, and the third material detection process may be performed by rotating the drum 130 at a constant speed.

As described above, data obtained by performing the material detection process at each of the plurality of water supply processes may include weight information of wet laundry that is changed in stages by the stepwise water supply, as shown in FIG. 17. That is, it may be considered that the data obtained during the three water supply processes performed until a target water level is reached may include weight information of the wet laundry after the first water supply, weight information of the wet laundry after the second water supply, and weight information of the wet laundry after the third water supply. Accordingly, the material detection may be performed more accurately even in an event of error in a weight of dry laundry.

FIG. 18 is a table illustrating example stages of water supply process performed by a washing machine matches to a weight of laundry according to various embodiments.

For example, the number of water supply processes performed by the washing machine 100 may be determined based on a weight of laundry. Referring to the example of FIG. 18, in response to the weight of the laundry, e.g., the weight of the dry laundry, being in a range of 0 to 1 kg, a water supply process including a single stage, e.g., a single water supply process, may be performed. In response to the weight of the dry laundry being in a range of 1 to 2 kg, a water supply process including two stages, e.g., two water supply processes, may be performed. In response to the weight of the dry laundry being in a range of 2 to 3 kg, a water supply process including three stages, e.g., three water supply processes, may be performed. In response to the weight of the dry laundry being in a range of 3 to 4 kg, a water supply process including four stages, e.g., four water supply processes, may be performed. In response to the weight of the dry laundry being in a range of 4 to 5 kg, a water supply process including five stages, e.g., five water supply processes, may be performed.

However, the table of FIG. 18 is merely an example applicable to various embodiments of the washing machine 100. The weight of the laundry and the number of water supply processes may be matched in another manner, and the predetermined number of water supply processes may be performed regardless of the weight of the laundry.

Figure 19:
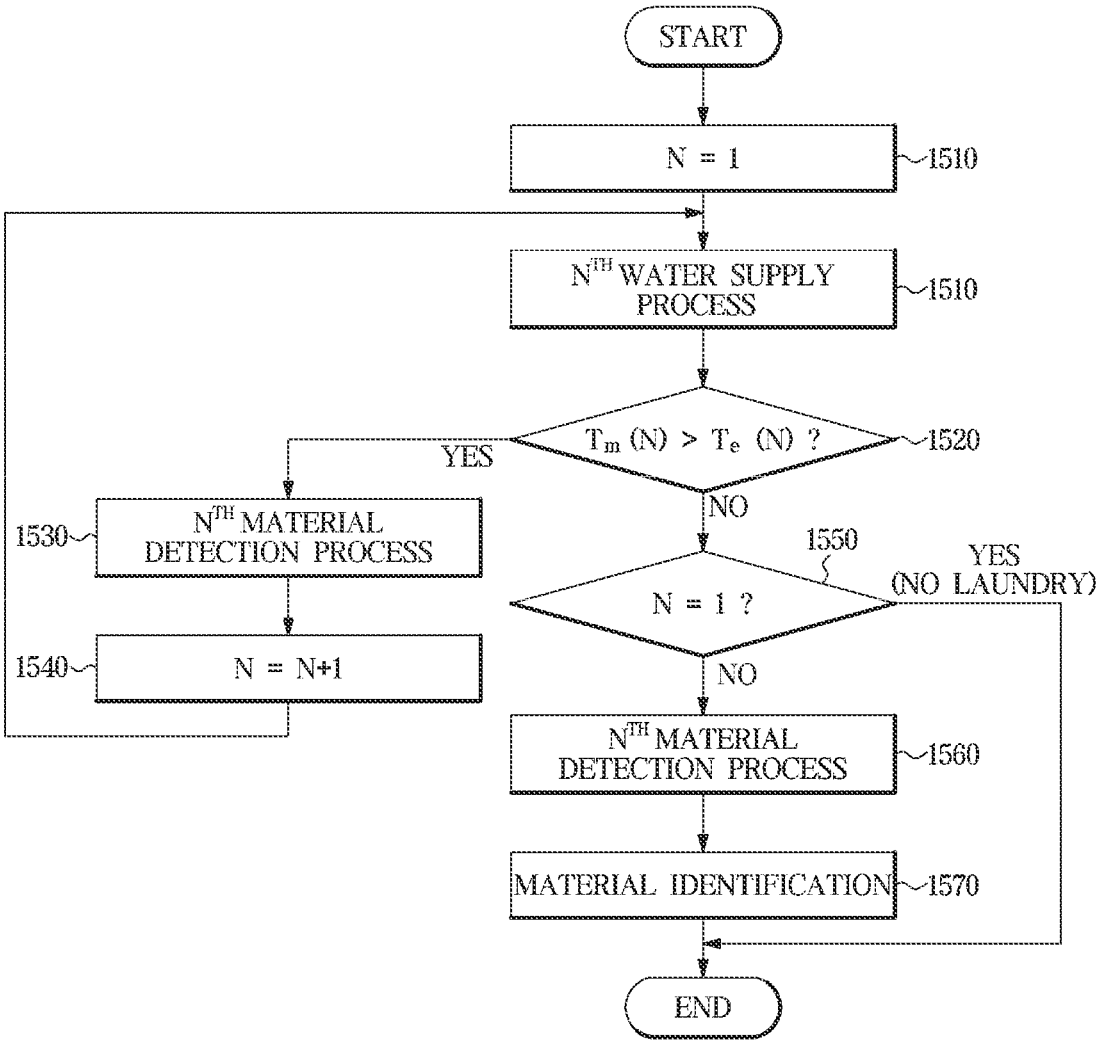
FIG. 19 is a flowchart illustrating an example of adjusting stages of water supply process by a washing machine according to various embodiments.

FIG. 19 is a flowchart illustrating an example of adjusting stages of water supply process by a washing machine according to various embodiments.

Even before all of the predetermined number of water supply processes are performed, in a case where laundry is considered sufficiently wet, the washing machine 100 according to an embodiment may cancel a subsequent water supply. That is, the washing machine 100 may perform no further water supply.

Whether the laundry is sufficiently wet may be identified based on a time taken for the water supply, e.g. a water supply time. In response to the laundry not being wet, water supplied is used to wet the laundry, and thus it will take longer than the time it would take to supply water up to the same water level without the laundry. That is, a greater amount of water is required.

Accordingly, the controller 190 may identify whether the laundry is sufficiently wet by comparing the time taken for water supply to a predetermined water level or the amount of water used for water supply to the predetermined water level with a reference value. Here, the reference value may be a time taken for water supply to the predetermined water level in the absence of laundry, or the amount of water used for water supply to the predetermined water level in the absence of laundry. In the embodiment described below, the reference value is time.

Referring to FIG. 19, a first water supply process is performed (1510), and a time taken for the first water supply process (Tm(1)) is compared to a reference time (Te(1)) (1520). In response to the time (Tm(1)) taken for the first water process being greater than the reference time (Te(1)), a first material detection process is performed (1530), and a second water process is performed(1540).

In response to the time (Tm(1)) taken for the first water supply process not being longer than the reference time (Te(1)) (yes of 1550), it may be considered that no laundry exists, and thus a wash course may be terminated.

In response to performing a second water supply process, a time taken for the second water supply process (Tm(2)) is compared to a reference time (Te(2)). In response to the time (Tm(2)) taken for the second water supply process being longer than the reference time (Te(2)), a second material detection process is performed and a third water supply process is performed.

In response to the time (Tm(2)) taken for the second water supply process not being longer than the reference time (Te(2)) (no of 1550), the laundry is considered sufficiently wet, a second material detection process may be performed without performing an additional water supply process (1560, 1570).

As described above, by determining a degree of wetness of the laundry and adjusting the stages of water supply, time and water required for material detection may be saved.

On the other hand, even in a case where a water supply process is divided into a plurality of stages, a feature of identifying a material using a classifier pre-trained by machine learning may be equally applicable. Accordingly, the above description related to material identification, although not stated in the description below, may be equally applied to an embodiment of the washing machine performing a plurality of water supply processes, unless there are specific circumstances that preclude its application. Hereinafter, an operation of identifying a material using data obtained through a plurality of water supply processes is described in greater detail.

Figure 20:
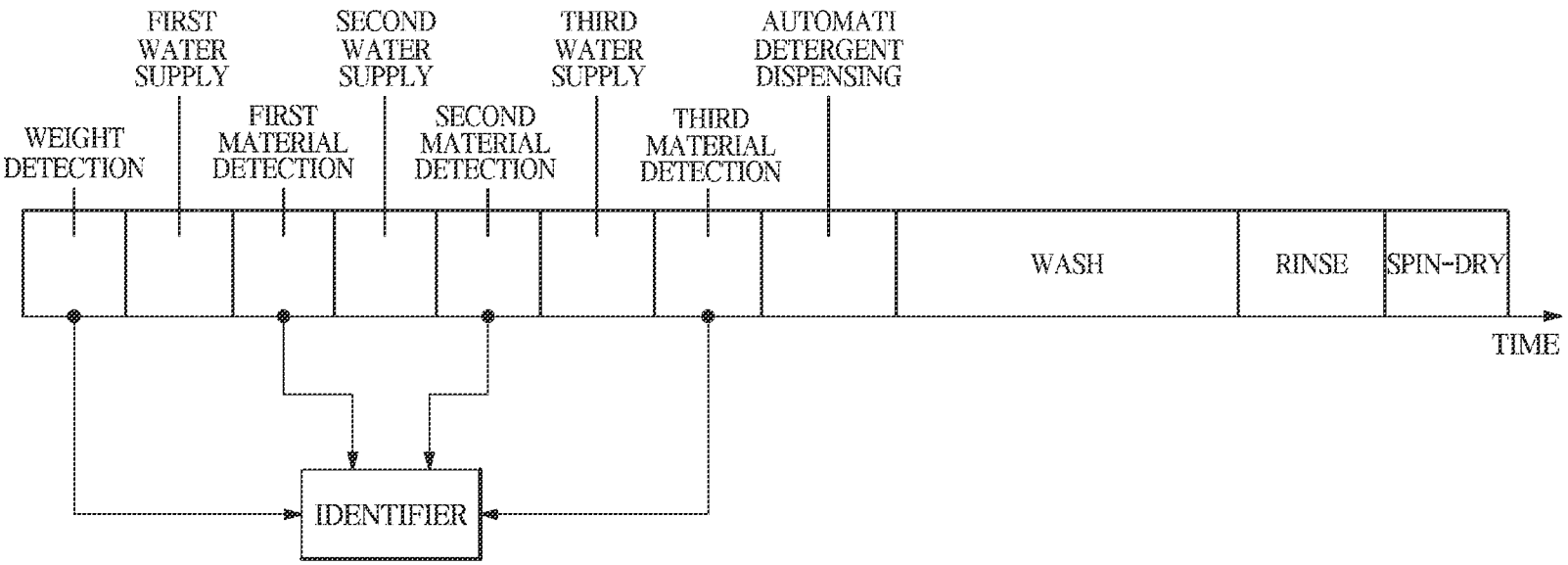
FIG. 20 is a timing chart illustrating an example process of identifying a material of laundry using data obtained after a plurality of water supply processes by a washing machine according to various embodiments.
Figure 21:
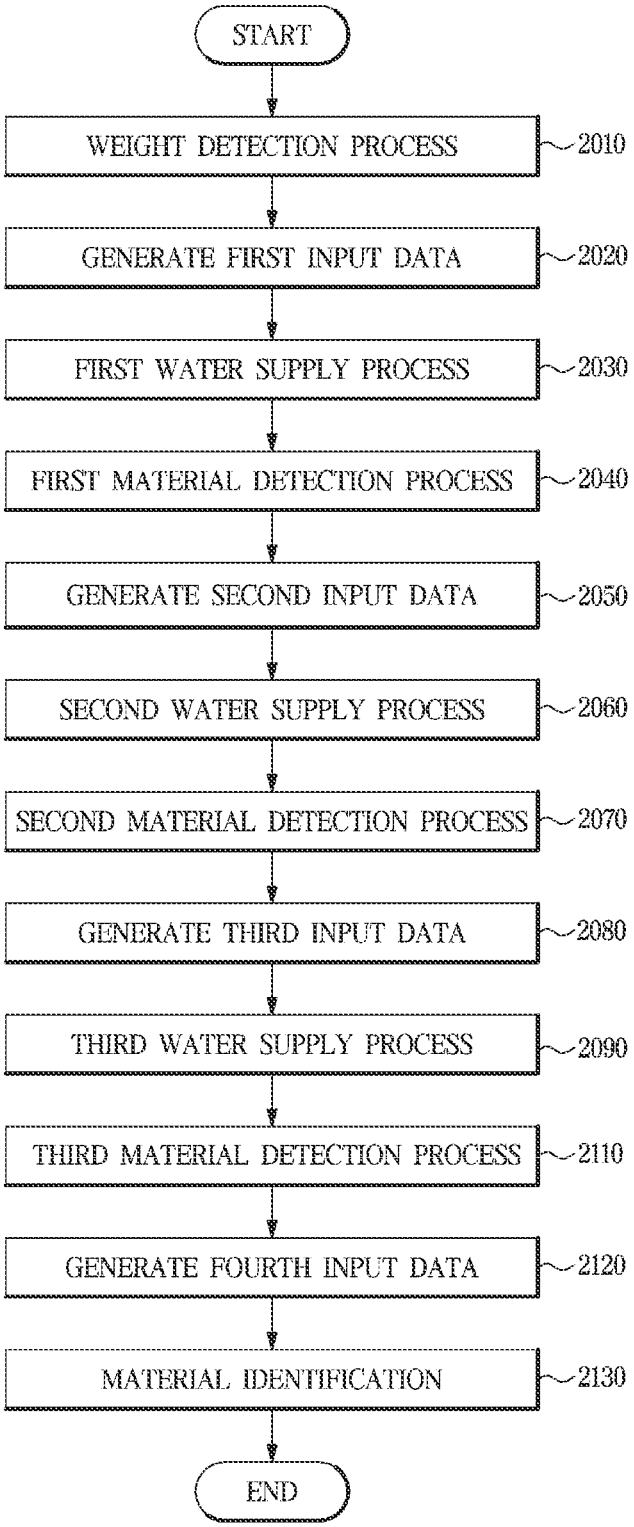
FIG. 21 is a flowchart illustrating an example process shown in FIG. 20 according to various embodiments.

FIG. 20 is a timing chart illustrating an example process of identifying a material of laundry using data obtained after a plurality of water supply processes by a washing machine according to various embodiments. FIG. 21 is a flowchart illustrating the process shown in FIG. 20 according to various embodiments.

In the example of FIG. 20, input data obtained through a weight detection process, three water supply processes, and three material detection processes is input to a single classifier. Accordingly, the single classifier used in the example of FIG. 20 corresponds to a multiple-process classifier for the weight detection process, a first material detection process, a second material detection process, and a third material detection process.

Referring to the flowchart of FIG. 21 together, the weight detection process is performed (2010) before supplying water to the drum 130.

In the weight detection process, a drive current of the motor 140 may be detected while rotating the drum 130 without water, e.g., the drum 130 accommodating dry laundry, at a constant speed.

The controller 190 may generate first input data from current values of the motor 140 obtained during the weight detection process (2020). The first input data is data that is input to the classifier of FIG. 20. Accordingly, the first input data may be generated in the same form as the input data used to train the classifier of FIG. 20. For example, in response to using frequency components of the current values of the motor to train the classifier, the first input data representing the frequency components of the current values of the motor 140 may be generated. Alternatively, in response to using an alignment pattern of the current values of the motor to train the classifier, the first input data representing the alignment pattern of the current values of the motor 140 may be generated.

The controller 190 may identify a weight of laundry based on the current values of the motor 140 obtained through the weight detection process, and may determine a final target water level based on the weight of the laundry. The final target water level may be determined as a water level at which the laundry may be sufficiently wet. In a case where the washing machine 100 is equipped with an automatic detergent dispensing function, the final target water level is a water level after the automatic detergent dispensing is completed. Accordingly, the final target water level may be determined to allow the laundry to be sufficiently wet, excluding the amount of water to be supplied upon automatic detergent dispensing.

As described above, the number of water supply processes to be performed may also be determined based on the weight of the laundry, and the predetermined number of water supply processes may be performed regardless of the weight of the laundry.

The controller 190 may determine a target water level for each water supply process, based on the target water level and the number of water supply processes.

The controller 190 controls the water supplier 150 to perform a first water supply process to provide water to a first target water level (2030).

In response to the first water supply process being completed, the controller 190 rotates the drum 130 at a constant speed to perform a first material detection process (2040).

The controller 190 generates second input data based on current values of the motor 140 obtained during the first material detection process (2050). The second input data is input data that is input to the classifier of FIG. 20. Accordingly, the second input data may be generated in the same form as the input data used to train the classifier of FIG. 20.

The controller 190 controls the water supplier 150 to perform a second water supply process to supply water to a second target water level (2060).

In response to the second water supply process being completed, the controller 190 rotates the drum 130 at a constant speed to perform a second material detection process (2070).

The controller 190 generates third input data based on current values of the motor 140 obtained during the second material detection process (2080). The third input data is input data that is input to the classifier of FIG. 20. Accordingly, the third input data may be generated in the same form as the input data used to train the classifier of FIG. 20.

The controller 190 controls the water supplier 150 to perform a third water supply process to supply water to a third target water level (2090).

In response to the third water supply process being completed, the controller 190 rotates the drum 130 at a constant speed to perform a third material detection process (2110).

The controller 190 generates fourth input data based on current values of the motor 140 obtained during the third material detection process (2120). The fourth input data is input data that is input to the classifier of FIG. 20. Accordingly, the fourth input data may be generated in the same form as the input data used to train the classifier of FIG. 20.

The controller 190 may identify the material of the laundry based on the generated input data (2130).

As described above, the classifier of FIG. 20 corresponds to a multiple-process classifier for the weight detection process, the first material detection process, the second material detection process, and the third material detection process. Accordingly, the controller 190 may input data concatenating the first input data, the second input data, the third input data, and the fourth input data, to the classifier, and identify an output of the classifier as the material of the laundry accommodated in the drum 130.

Alternatively, the material of the laundry may be identified using a plurality of classifiers even in a case where water supply processes are performed in stages, which is described in greater detail below with reference to FIG. 22 to FIG. 25.

Figure 22:
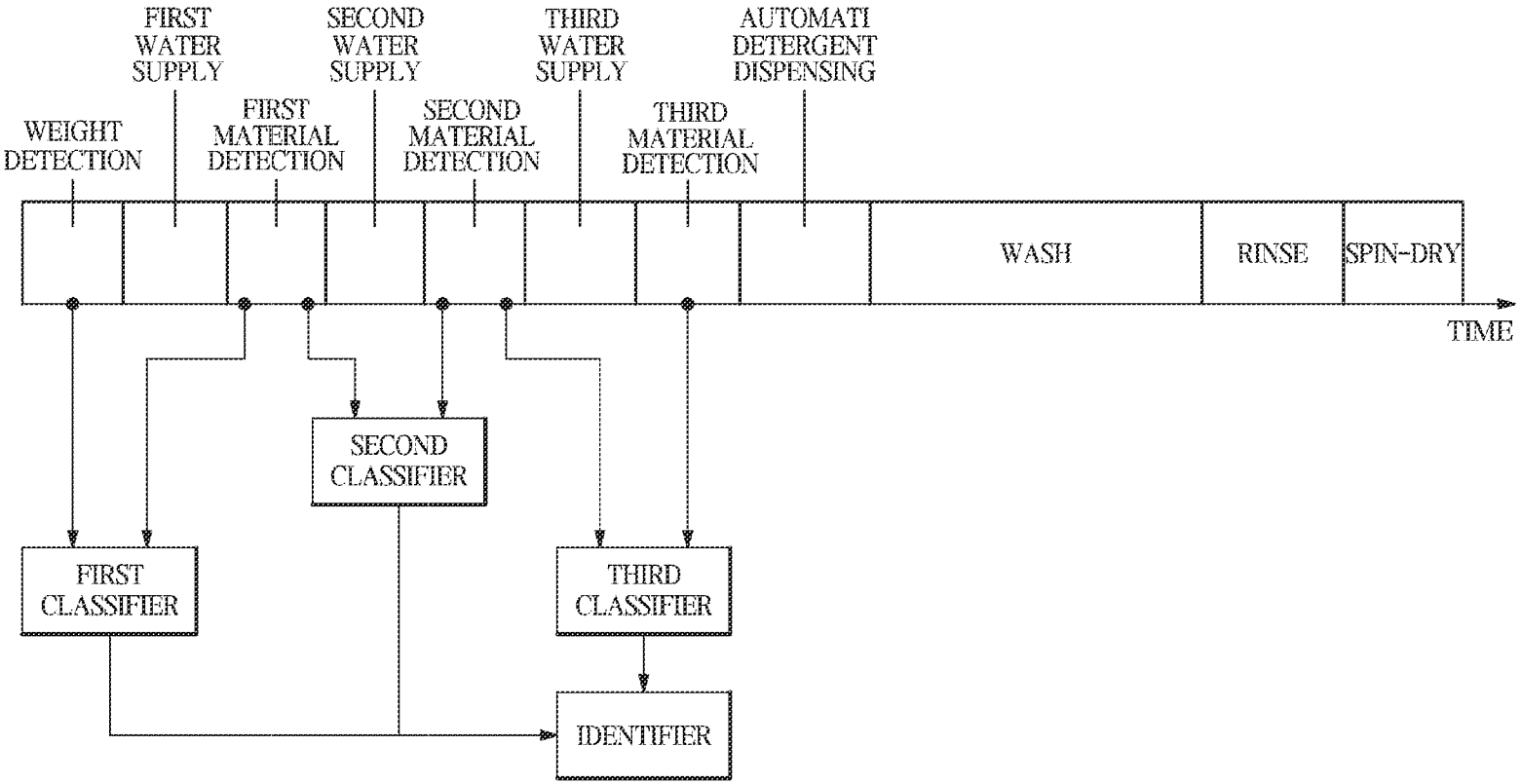
FIG. 22 and FIG. 23 are timing charts illustrating example processes of identifying a material of laundry before performing a washing process by a washing machine according to various embodiments.
Figure 23:
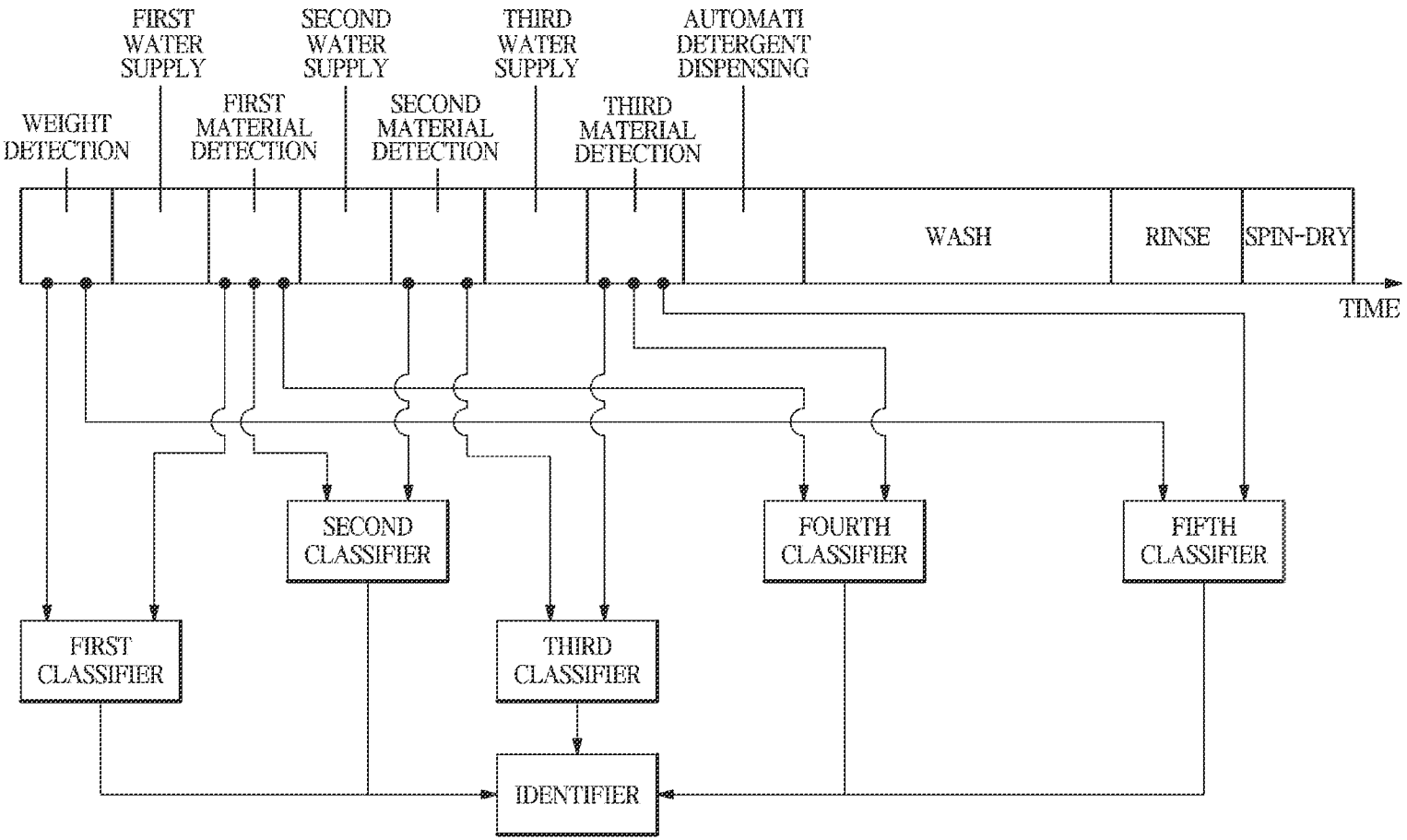

FIG. 22 and FIG. 23 are timing charts illustrating example processes of identifying a material of laundry before performing a washing process by a washing machine according to various embodiments.

Operations of performing a respective process and generating input data may be the same as described above with reference to FIG. 20 and FIG. 21.

Referring to the example of FIG. 22, three classifiers may be stored in the controller 190, and all of the three classifiers correspond to a multiple-process classifier.

A first classifier is a multiple-process classifier for a weight detection process and a first material detection process, a second classifier is a multiple-process classifier for the first material detection process and a second material detection process, and a third classifier is a multiple-process classifier for the second material detection process and a third material detection process.

For material identification, the controller 190 may input data concatenating first input data and second input data to the first classifier, may input data concatenating the second input data and third input data to the second classifier, and may input data concatenating the third input data and fourth input data to the third classifier.

The identifier may identify a material of laundry based on the output of the first classifier, the output of the second classifier, and the output of the third classifier. An operation of identifying the material by applying weights to the output data of the plurality of classifiers is the same as or similar to those described above with reference to FIG. 11 and FIG. 14.

Referring to the example of FIG. 23, five classifiers may be stored in the controller 190, and all the five classifiers correspond to a multiple-process classifier.

A first classifier is a multiple-process classifier for a weight detection process and a first material detection process, a second classifier is a multiple-process classifier for the first material detection process and a second material detection process, and a third classifier is a multiple-process classifier for the second material detection process and a third material detection process.

A fourth classifier is a multiple-process classifier for the first material detection process and the third material detection process, and a fifth classifier is a multiple-process classifier for the weight detection process and the third material detection process.

Accordingly, for material identification, the controller 190 may input data concatenating first input data and second input data to the first classifier, may input data concatenating the second input data and third input data to the second classifier, and may input data concatenating the third input data and fourth input data to the third classifier.

In addition, data concatenating the second input data and the fourth input data may be input to the fourth classifier, and data concatenating the first input data and the fourth input data may be input to the fifth classifier.

The identifier may identify a material of laundry based on the output of the first classifier, the output of the second classifier, the output of the third classifier, the output of the fourth classifier, and the output of the fifth classifier. An operation of identifying the material by applying weights to the output data of the plurality of classifiers is the same as or similar to those described above with reference to FIG. 11 and FIG. 14.

The controller 190 may determine process conditions to be applied to subsequent processes based on the material output from the identifier of FIG. 22 and FIG. 23, and may perform an automatic detergent dispensing process, a washing process, a rinse process, and a spin-dry process according to the determined process conditions.

Alternatively, the material identification may be additionally performed after starting the washing process.

Figure 24:
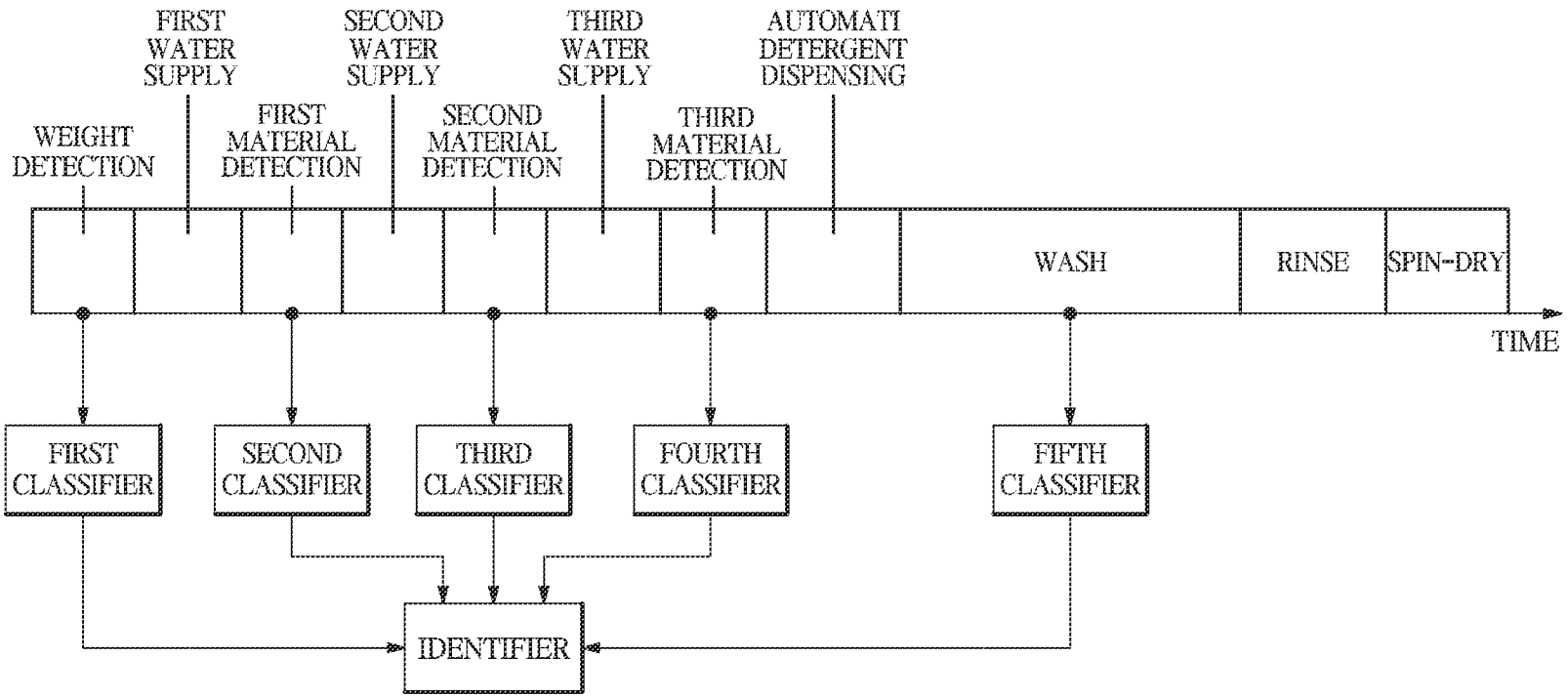
FIG. 24 and FIG. 25 are timing charts illustrating example processes of additionally identifying a material of laundry after starting a washing process by a washing machine according to various embodiments.
Figure 25:
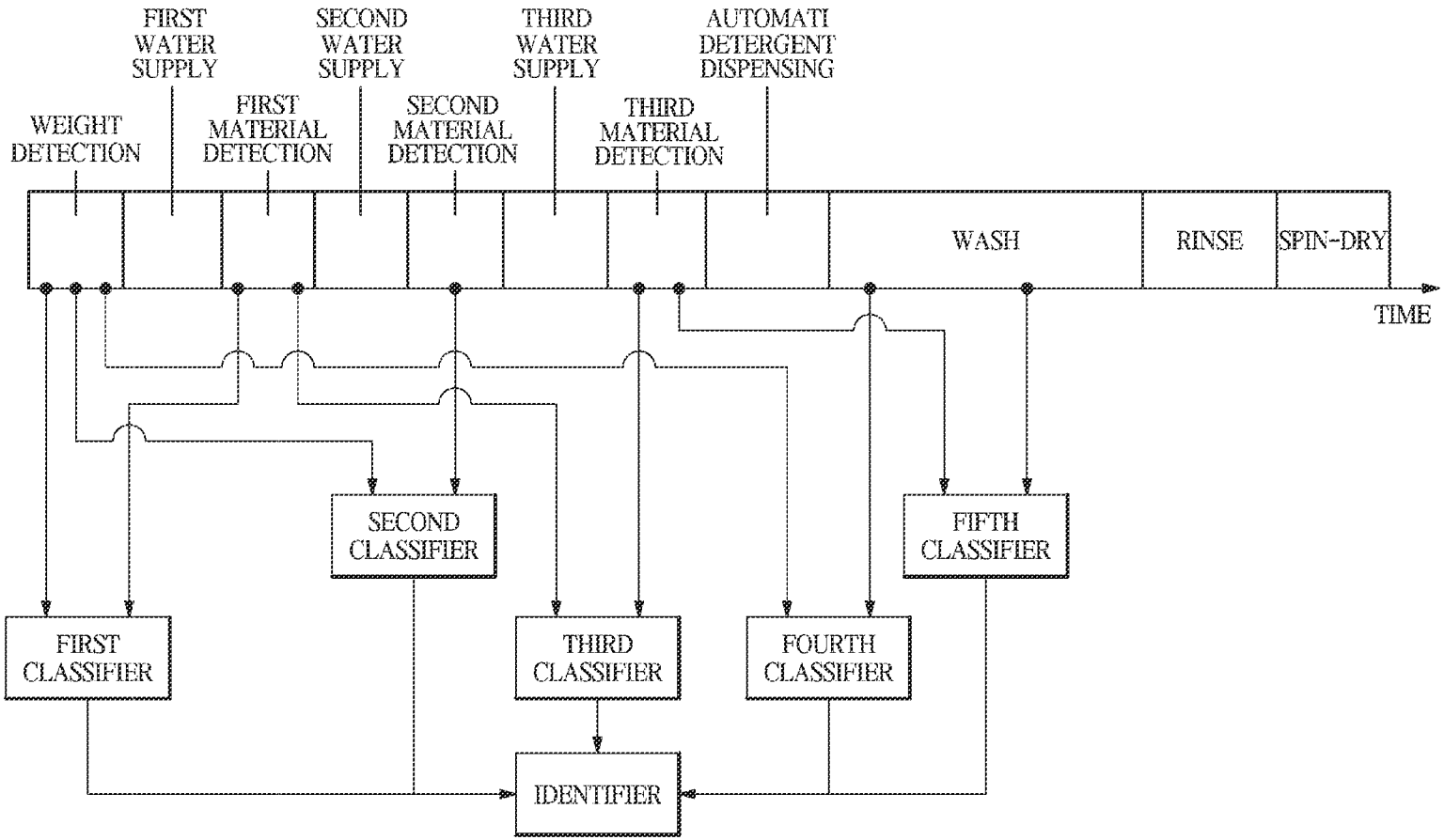

FIG. 24 and FIG. 25 are timing charts illustrating example processes of additionally identifying a material of laundry after starting a washing process by a washing machine according to various embodiments.

Referring to the example of FIG. 24, five classifiers may be stored in the controller 190, all the five classifiers correspond to a single-process classifier.

A first classifier is a single-process classifier for a weight detection process, a second classifier is a single-process classifier for a first material detection process, and a third classifier is a single-process classifier for a second material detection process. A fourth classifier is a single-process classifier for a third material detection process, and a fifth classifier is a single-process classifier for a washing process.

The controller 190 may generate first input data from current values of the motor 140 obtained during the weight detection process, generate second input data from current values of the motor 140 obtained during the first material detection process, generate third input data from current values of the motor 140 obtained during the second material detection process, and generate fourth input data from current values of the motor 140 obtained during the third material detection process.

The controller 190 may input the first input data to the first classifier, input the second input data to the second classifier, input the third input data to the third classifier, and input the fourth input data to the fourth classifier.

The identifier of the controller 190 may perform a first material identification based on the output of the first classifier, the output of the second classifier, the output of the third classifier, and the output of the fourth classifier.

Based on a result of the first material identification, the controller 190 may determine process conditions to be applied to subsequent processes. The controller 190 may also perform an automatic detergent dispensing process and a washing process based on the determined process conditions.

The controller 190 may generate fifth input data from current values of the motor 140 obtained during the washing process. The fifth input data may be input to the fifth classifier, and the identifier may perform a second material identification based on an output of the fifth classifier. As described above, the process conditions may be changed or maintained depending on a result of the second material identification.

Referring to the example of FIG. 25, five classifiers may be stored in the controller 190, and all the five classifiers correspond to a multiple-process classifier.

A first classifier is a multiple-process classifier for a weight detection process and a first material detection process, a second classifier is a multiple-process classifier for the weight detection process and a second material detection process, and a third classifier is a multiple-process classifier for the first material detection process and a third material detection process. A fourth classifier is a multiple-process classifier for the weight detection process and a washing process, and a fifth classifier is a multiple-process classifier for the third material detection process and the washing process.

The controller 190 may generate first input data from current values of the motor 140 obtained during the weight detection process, generate second input data from current values of the motor 140 obtained during the first material detection process, generate third input data from current values of the motor 140 obtained during the second material detection process, and generate fourth input data from current values of the motor 140 obtained during the third material detection process.

The controller 190 may input data concatenating the first input data and the second input data to the first classifier, data concatenating the first input data and the third input data to the second classifier, and data concatenating the second input data and the fourth input data to the third classifier.

The identifier of the controller 190 may perform a first material identification based on the output of the first classifier, the output of the second classifier, and the output of the third classifier.

Based on a result of the first material identification, the controller 190 may determine process conditions to be applied to subsequent processes. The controller 190 may also perform an automatic detergent dispensing process and the washing process based on the determined process conditions.

The controller 190 may generate fifth input data from current values of the motor 140 obtained during the washing process. Data concatenating the fifth input data and the first input data may be input to the fourth classifier, and data concatenating the fourth input data and the fifth input data may be input to the fifth classifier.

The identifier of the controller 190 may perform a second material identification based on the output of the fourth classifier and the output of the fifth classifier. As described above, the process conditions may be changed or maintained depending on a result of the second material identification.

Meanwhile, the disclosed example embodiments may be embodied in the form of recording medium storing instructions executable by a computer. The instructions may be stored in the form of program code and, when executed by a processor, may generate a program module to perform the operations of the disclosed embodiments. The recording medium may be implemented as a computer-readable recording medium.

The computer-readable recording medium may include all kinds of recording media in which instructions which may be decoded by a computer are stored of, for example, a read only memory (ROM), random access memory (RAM), magnetic tapes, magnetic disks, flash memories, optical recording medium, and the like.

The machine-readable storage medium may be provided in the form of a non-transitory storage medium. The 'non-transitory storage medium' may refer, for example, to a tangible device without including a signal, e.g., electromagnetic waves, and may not distinguish between storing data in the storage medium semi-permanently and temporarily. For example, the non-transitory storage medium may include a buffer that temporarily stores data.

The aforementioned methods according to the various embodiments of the disclosure may be provided in a computer program product. The computer program product may be a commercial product that may be traded between a seller and a buyer. The computer program product may be distributed in the form of a storage medium (e.g., a compact disc read only memory (CD-ROM)), through an application store (e.g., Play Store™), directly between two user devices (e.g., smartphones), or online (e.g., downloaded or uploaded). In the case of online distribution, at least part of the computer program product (e.g., a downloadable app) may be at least temporarily stored or arbitrarily created in a storage medium that may be readable to a device such as a server of the manufacturer, a server of the application store, or a relay server.

Although embodiments of the disclosure have been described with reference to the accompanying drawings, one of ordinary skill in the art will appreciate that various modifications may be easily made without departing from the technical spirit or scope of the disclosure, including the appended claims and their equivalents. Therefore, the foregoing embodiments should be regarded as illustrative rather than limiting in all aspects. It will also be understood that any of the embodiment(s) described herein may be used in conjunction with any other embodiment(s) described herein.

What is claimed is:

1. A washing machine, comprising:

a drum;

a motor configured to rotate the drum;

a motor driver comprising circuitry configured to supply a drive current to the motor;

a current sensor configured to detect the drive current;

a water supplier comprising a conduit configured to supply water to the drum; and at least one controller configured to control the water supplier to perform a plurality of water supply processes, and control the motor driver to rotate the drum, wherein one or more of the at least one controller is configured to:

perform one of a plurality of material detection processes in response to the at least one controller controlling the water supplier to perform one of the plurality of water supply processes, generate a plurality of pieces of input data based on drive current values detected by the current sensor while the drum is being rotated by the motor during each of the plurality of material detection processes, the plurality of pieces of input data including at least one of data about a frequency component of the drive current values detected during the plurality of material detection processes and data about an alignment pattern in which the drive current values are aligned in order of magnitude, and identify a material of laundry, accommodated in the drum, based on the plurality of pieces of input data including at least one of data about the frequency component of the drive current values detected during the plurality of material detection processes and data about the alignment pattern in which the drive current values are aligned in order of magnitude.

2. The washing machine of claim 1, wherein one or more of the at least one controller is configured to store a classifier pre-trained by machine learning, wherein:

the classifier is configured to output output data indicating the material of the laundry accommodated in the drum, in response to the plurality of pieces of input data being input.

3. The washing machine of claim 2, wherein one or more of the at least one controller is configured to determine a number of the plurality of water supply processes based on a weight of the laundry accommodated in the drum.

4. The washing machine of claim 2, wherein one or more of the at least one controller is configured to cancel a water supply process, in response to a water supply time or an amount of water supply for one of the plurality of water supply processes satisfying a specified condition.

5. The washing machine of claim 2, wherein one or more of the at least one controller is configured to control the motor driver to rotate the drum at a constant speed to perform the plurality of material detection processes.

6. The washing machine of claim 2, wherein the classifier is configured to include two or more classifiers pre-trained by two or more processes among the plurality of material detection processes and the plurality of weight detection processes identifying a weight of the laundry before supplying water to the drum.

7. The washing machine of claim 6, wherein one or more of the at least one controller is configured to identify the material of the laundry, accommodated in the drum, based on output data output from each of the two or more classifiers.

8. The washing machine of claim 2, wherein one or more of the at least one controller is configured to, in response to the plurality of material detection processes being performed, identify the material of the laundry based on the plurality of pieces of input data, and determine a process condition related to at least one of a washing process, a rinse process, or a spin-dry process based on the identified material of the laundry.

9. The washing machine of claim 8, wherein one or more of the at least one controller is configured to perform the washing process based on the plurality of material detection processes, generate input data based on the value of the drive current detected during the washing process, and identify the material of the laundry, accommodated in the drum, based on the generated input data.

* * * * *